US012790932B2

(12) United States Patent
Paturu

(10) Patent No.: US 12,790,932 B2
(45) Date of Patent: Nov. 10, 2026

(54) WELL BORE TO OCEANIC DIVERSION OF A GAS ENTRAINMENT WITH PREVENTION AND RESTORATION ABOUT A WELL BLOW OUT

(71) Applicant: Sumathi Paturu, Huntsville, AL (US)

(72) Inventor: Sumathi Paturu, Huntsville, AL (US)

(73) Assignee: Paturu Sumathi, Huntsville, AL (US)

( * ) Notice: Subject to any disclaimer, the term of this patent is extended or adjusted under 35 U.S.C. 154(b) by 401 days.

(21) Appl. No.: 17/803,746

(22) Filed: Nov. 4, 2022

(65) Prior Publication Data

US 2024/0151131 A1 May 9, 2024

(51) Int. Cl.
*E21B 43/36* (2006.01)
*E21B 33/064* (2006.01)

(52) U.S. Cl.
CPC ..... *E21B 43/36* (2013.01); *E21B 33/064* (2013.01)

(58) Field of Classification Search
CPC ..... E21B 43/26; E21B 33/064; E21B 43/0122
USPC ..... 166/357
See application file for complete search history.

(56) References Cited

U.S. PATENT DOCUMENTS 4,091,881 A * 5/1978 Maus ..... E21B 21/08 175/48
4,416,565 A * 11/1983 Ostlund ..... E21B 43/0122 210/170.11
7,093,661 B2 * 8/2006 Olsen ..... E21B 43/0175 166/266
8,322,473 B2 * 12/2012 Hilberer ..... B60W 10/08 180/65.265
10,871,055 B2 * 12/2020 Paturu ..... B01D 19/0042
11,345,185 B2 * 5/2022 Marsala ..... G05B 13/028
11,619,116 B2 * 4/2023 Ionkina ..... E21B 47/12 166/249
11,939,248 B2 * 3/2024 Willberg ..... C02F 11/04
2004/0238179 A1 * 12/2004 Murray ..... E21B 43/38 166/105.5
2008/0123470 A1 * 5/2008 Cooper ..... E21B 33/0355 175/25
2017/0122091 A1 * 5/2017 Paturu ..... E21B 43/36

* cited by examiner

*Primary Examiner* — Matthew R Buck
*Assistant Examiner* — Douglas S Wood

(57) ABSTRACT

Diversion of a pressured Gas Entrainment from the well bore and the riser pipe by devised 'Gas Entrainment Diversion Tubing' (GDT) prevents well head blow-out and rig-fire, the GDT incorporating the Inventor devised 'Basket-pneumosphere' one way valves. Two configured GDT means are—tunneling cemented casings; devising casement passageways during manufacturing, the GDT made as flexible duct-tubing, later cemented-embedded via casing shoe. A 'Sea Level Gas Separator of Oil Well Effluent' (SLGOE) unit working in conjunction, instantly separates inflammable gases from the oil-gas effluent following a gas entrainment as also on a regular basis, the latter facilitating weaning of 'flaring' by oil companies, mitigating global warming. The effluent received by the SLGOE unit upon well head blow-out being a water-oil admixture, a devised Oil Separator Tank isolates the oil from water admixed effluent. A motivating disclosure is also made regarding carbon foot print, carbon capture, and climate change.

11 Claims, 10 Drawing Sheets

Figure 1A:
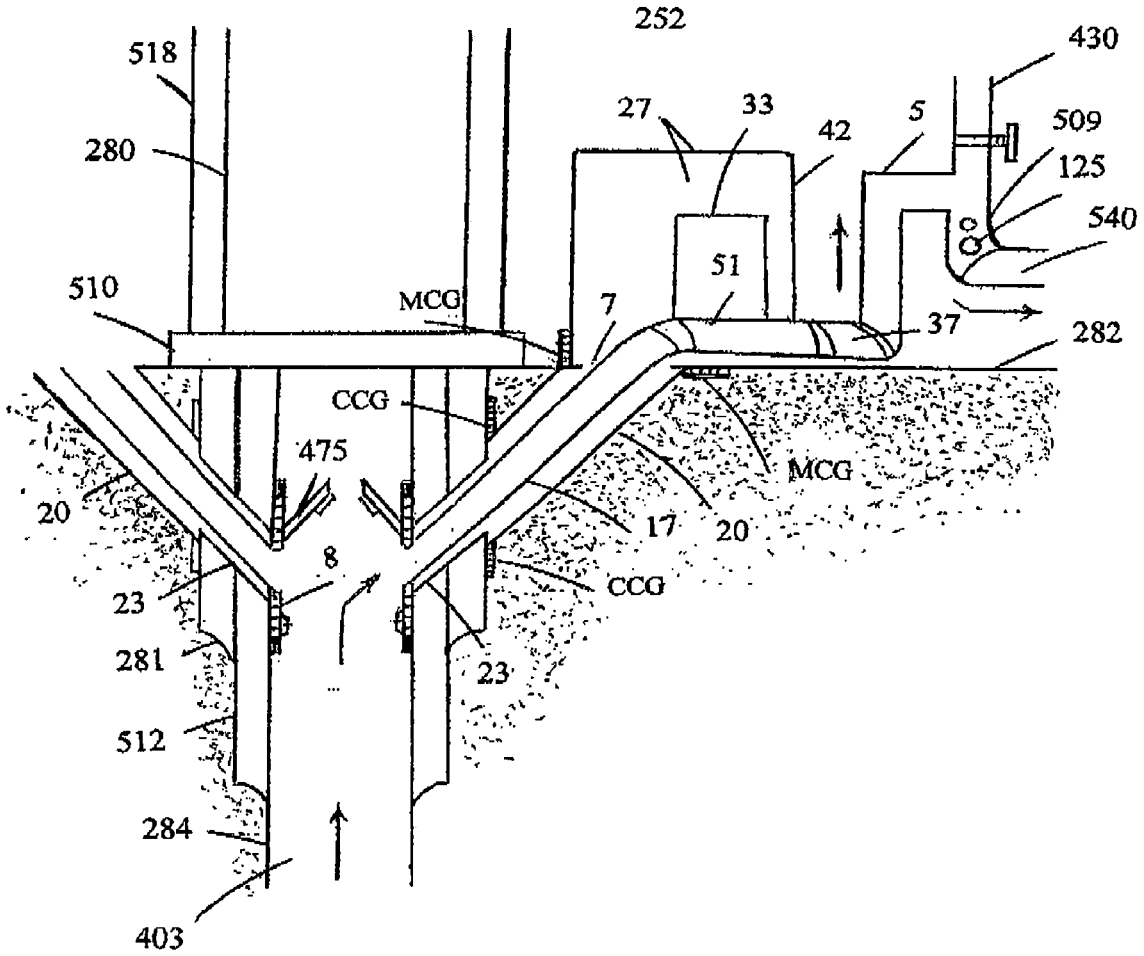

WELL BORE TO OCEANIC DIVERSION OF A GAS ENTRAINMENT WITH PREVENTION AND RESTORATION ABOUT A WELL BLOW OUT

CROSS REFERENCE TO RELATED

U.S. Pat. No. 9,175,549; FILING DATE: Jun. 6, 2011 APPLICATIONS TITLE: EMERGENCY SALVAGE OF A CRUMBLED OCEANIC OIL WELL

U.S. Pat. No. 9,879,517; FILING DATE: Nov. 3, 2015 TITLE: SUBSEA LEVEL GAS SEPARATOR OF CRUDE PETROLEUM OIL

U.S. patent Ser. No. 10/871,055; FILING DATE: Jan. 30, 2018

This is a Continuation application of U.S. Pat. No. 10,871,055 (with a filing date of Jan. 30, 2018) which is a continuation-in-part Application of U.S. Pat. No. 9,879,517 (Nov. 3, 2015) which in turn is a continuation-in-part Application of U.S. Pat. No. 9,175,549 (Jun. 6, 2011).

STATEMENT REGARDING FEDERALLY SPONSORED RESEARCH

NOT FEDERALLY SPONSORED NOR THERE WAS JOINT RESEARCH AGREEMENT.

BACKGROUND OF THE INVENTION

There are innumerable petroleum oil wells bored into the ocean floor by highly evolved modern devices to tap the petroleum (crude oil) reservoirs. Many oil wells are of significant distance from the coast line, such wells bored through the ocean floor as deep as ⅛th of a mile from the surface waters, to find their way to the underground oil containments spread many miles in area. The recent advances are making well digging in deeper waters an easier accomplishment than it was before. Oil is collected into surface tanks sized as moderate containers, or into receptacles as large as ships.

Historically, the production of petroleum from the earth's mantle in the ocean floor is shrouded in risk and great hazard to the natural environment that includes both the marine life forms and the terrestrial ecosystem adjacent. The greatest hazard is the entrainment and ignition of highly inflammable gases like Methane, causing dangerous fires, coupled with the risk of oil spewing and polluting the ocean waters. Such two manmade calamities at the same time can be uncontrollable with available resources, and devastating to the healthy existence of the earth's planetary life forms. For these reasons, error proof safety systems in under water bore well digging and highly trained personnel involved in their operations, are required by law in all countries engaged in significant oil production. Despite such stringent laws, system failures and catastrophic results did occur historically, and are still occurring. The derived remedial measures through the 'adverse event experiences' though each is uniquely different from the other in some form or other, are still nascent, and less than perfect. The recent event in the Gulf Shores of Mexico, involving BP oil company's oil well under construction (the Macondo Prospect oil well of the Deep Water Horizon), wherein the ignition of the entrained gas and its fire that continued unstopped for 36 hours had culminated in collapse of the surface well structures, resulting in an ever increasing gusher from the source. Several different attempts by the BP oil company's technological team to contain the spewing geyser from finding its way into the body of water and into the Gulf shores had failed, mostly due to inherently limited robotic attempts involved in a moderately deep aquatic habitat.

As any unforeseen adversity can happen at any time before the completion of the well to its last functional detail, safety measures to weather out any event at any step of the construction have to be in place before beginning such operation. This application enumerating a model of 'Well Bore to Oceanic Diversion of a Gas Entrainment with Prevention and Restoration about a Well Head Blow Out' includes means and method steps to be incorporated for dividing and diverting a pressured giant gas entrainment from the well bore into the body of oceanic waters, to be dwarfed and subdued in its pressure within the ocean grounds.

There are plurality of measures otherwise operative, described in the cross referenced patent 'Emergency Salvage of a Crumbled Oceanic Oil Well' (U.S. Pat. No. 9,175,549) by the Inventor Applicant, and can be consulted, said measures working in synchrony to weather out unforeseen events about the course of a well construction. A recently filed US application (Ser. No. 17/803,373, titled 'Off Shore Fire Escape Devices including Sinking and Rising of a Detachable Island Rig') comprises a subject matter of great significance for being preventive as also remedial in scope, of otherwise catastrophic and totally devastating consequences of a rig fire.

Many inadvertent and unforeseen consequences are inherent to such ventures as the deep sea explorations shrouded in dangers and counting on tides of nature, yet to be conquered by the technological sophistication. Accordingly, the Author Inventor is neither legally liable nor personally responsible for any adverse events (involving marine-terrestrial life forms as also the eco-system) difficult to differentiate either as a mere association or as a consequence of the application of the structural and or procedural information herein enumerated. The structural and or procedural application of this disclosure that involves analyzing and adapting swiftly to unforeseen situations that are innumerable and uniquely different, is obviously a personal choice and responsibility discreetly and voluntarily undertaken by the involved company participating in the day to day practice of this invention, in part or as a whole, for which reason also the Inventor may not be held responsible or accountable for any adverse event consequences.

BRIEF DESCRIPTION OF THE INVENTION

The present invention is drawn to a working model of 'Well Bore to Oceanic Diversion of a Gas Entrainment' whereby the most sought after goal of Prevention of a Well Head Blow out is more probably achieved rather than not. The Invention is designed to divert a pressured gas entrainment into the oceanic waters nearly to a total extent, additionally precluding it from finding its way into the rig, historically a known venue of danger, wherein an ignition spark is most likely encountered. The devised system endeavors to prevent well head blowout by a devised 'Well Bore Gas Entrainment Diversion Tubing' (WGDT). Despite the provision of a WGDT with its superior benefits, it is not taken for granted that a well head blow out is always prevented, as nature's wrath can surpass all human endeavors. Hence, when a well head blow out does happen, it is imperative that the pressured gas entrainment is subdued on its way to the rig through the marine riser, by means of a 'Riser Gas Entrainment Diversion Tubing' (RGDT) that yet additionally diverts the pressured elements into ocean waters so as it is precluded to reach the rig level. Both WGDT and RGDT incorporate one way valves so as there are only effluent let-outs, but not let-ins of ocean waters. The pressured effluent diverted into ocean waters is fractionated and subdued to be collected into specially devised ocean floor gas-oil receptacles, wherein oil-gas-water separation occurs for the gas and oil to enter the land collection system.

Two models are herein devised—(a) an immediate provision of tunneling the cemented casings to create WGDT on either side of the well; (b) a possible future project of WGDT Construction with Casing Pass ways WCCP), wherein the pass ways are incorporated into the well casings while manufacturing; during the casing deployment into the well bore, said passage ways are joined within the annular spaces by flexibly configured individual segmental WGDT components made as duct tubing constructed by coating vulcanized silicone rubber upon silica fabric (96% pure Si $O_2$ woven into flexible textile to resists temp up to 500° F.), with thin steel spring wire to prevent collapse; the individual segmental silicone WGDT being cemented around soon, durability is not an issue.

A device of 'Sea Level Gas Separator of Oil Well Effluent' (SLGOE) unit is positioned in a rig vicinity, the unit required for separation and oceanic diversion of any pressured gaseous elements, thereby precluding them from reaching the rig level upon a well blow out, as also on a regular basis (the latter being optional), whereby on all occasions, only an effluent with minimally admixed gases reaches the rig level. The passage of a pressured effluent upon a well head blow out is effectuated through a safe oxygen-free milieu of the SLGOE unit. Its functions can also be optionally elected, to prevail on a regular basis, for the oil-gas separation and gas collection in a safe controlled manner at the rig level, so as flaring can be confidently weaned off by the oil companies.

The invention further envisions immediate reparative/restorative measures about the breached well bore and marine riser that are easy to accomplish, and more often successful rather than not.

DRAWINGS

FIG. 1A: The drawing illustrates a schematic of—(a) a 'Well bore Gas entrainment Diversion Tubing' (WGDT) assuming a slanted disposition while originating from and traversing the superficial oceanic grounds and therefrom the tunneled well casements to reach the well bore, to be connected to a GDT flush plate and a GDT Closure (GDTC); (b) A 'Modular construction chamber' (MCC) on the ocean grounds to isolate ocean waters for deployment of the WGDT, while an 'Outgoing Entrainment Tubing' (OET) of the WGDT emerges from the MCC to be connected upon the ocean grounds with a conjoining tubing that joins with an Inverted J Tubing (IJT), wherein the down turned terminal of the IJT incorporates 'Basket-pneumosphere' one way valves that open to the enormous pressure of a giant gas entrainment, to divert the entrainment from within the well bore.

Figure 1B:
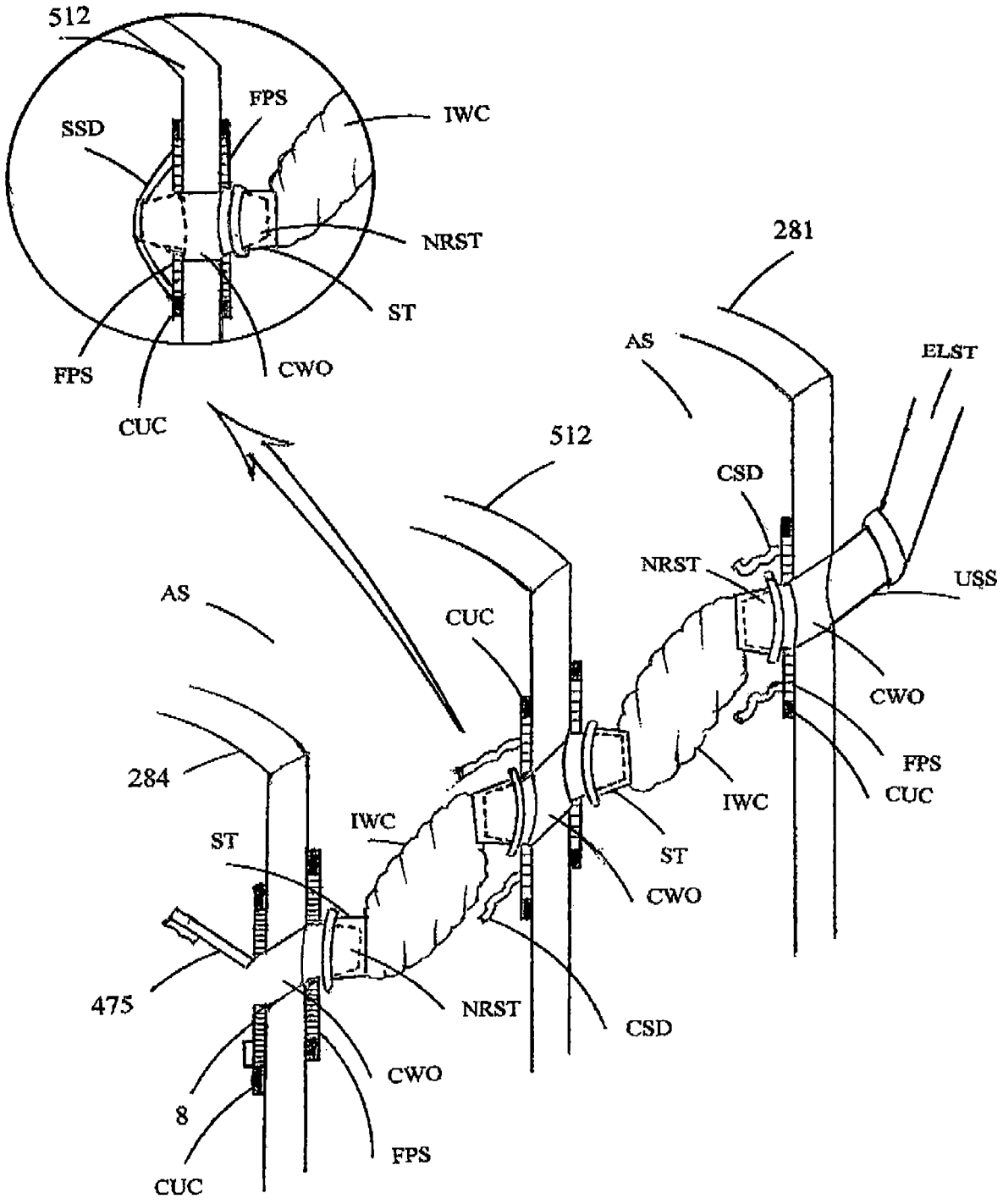

FIG. 1B: The drawing illustrates a schematic of a 'Well bore Gas entrainment Diversion Tubing' (WGDT) with WGDT Construction Casing Pass ways (WCCP), depicted as below-(a) a cross sectional as also vertical section of an oil well showing two optimally sized Circular WGDT Openings (CWO) about all well casings, for easy WGDT traversing from outside the conductor casing to the well bore, spanning through all the casings and the annuli; (b) the WGDT made as segmental Individual WGDT Components (IWC) having an overall slanted dis-position, the IWC traversing the annular space being made as vulcanized silicone duct tubing with wide Steel Terminals (ST), the ST shown to be fitting onto Nested Receptive Steel Tubing (NRST) of either casing in an annulus; (c) the NRST is mounted about a ring Flush Plate of Steel (FPS), while the well bore side NRST is being covered by a double layered Shielding Silicone Disc (SSD) (shown in an inset) that is cut upon deploying an inner casing; (c) the drawing showing a GDT flush plate with GDT Closure (GDTC) about the well bore, whereas the conductor casing about the ocean side of the CWO comprising a large Up Slanted Spout (USS) articulating with a Steel tubing, that ultimately conjoins the IJT with one way valves.

Figure 2:
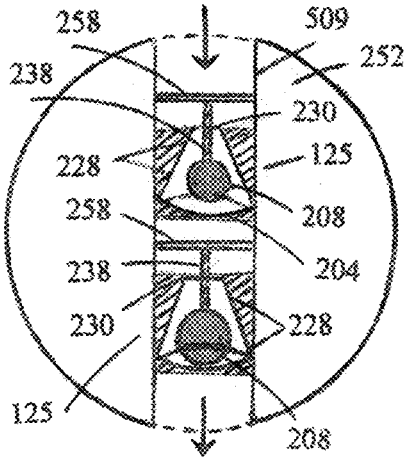

FIG. 2: The drawing illustrates-A schematic of a 'Basket-Pneumosphere' model of one way valve, as positioned within the down turned terminals of the gas entrainment diversion tubing of the well bore as also the gas entrainment diversion tubing of a marine riser.

Figure 3:
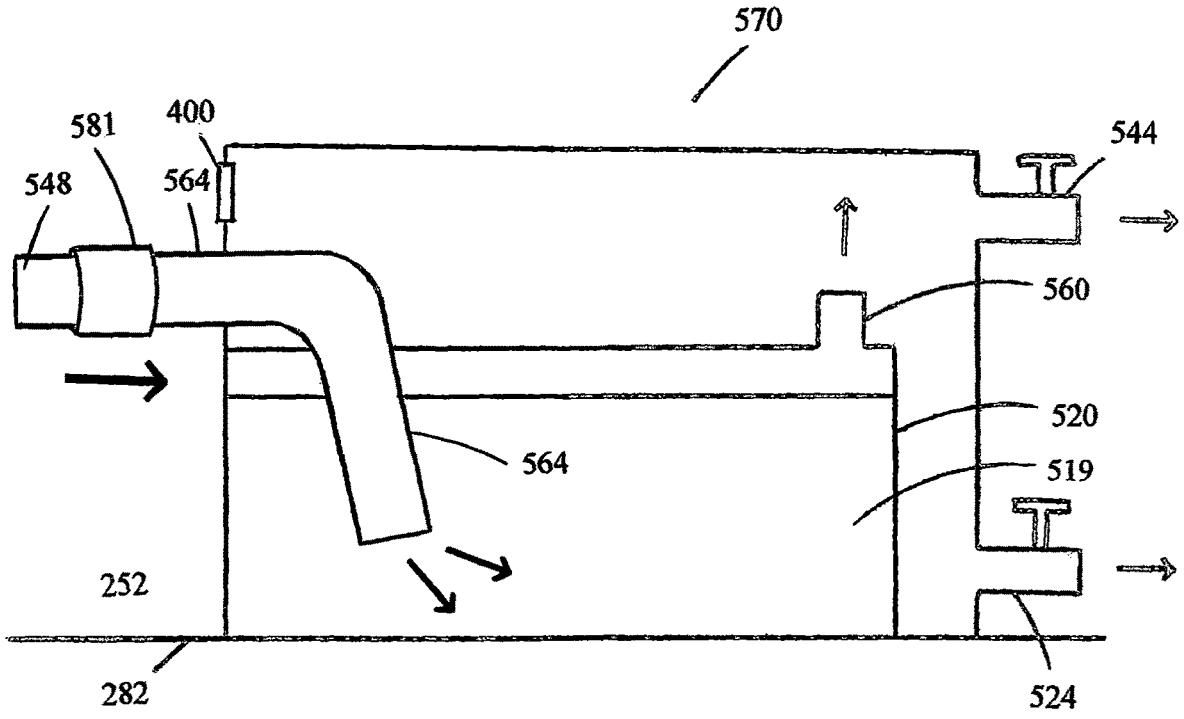

FIG. 3: The drawing illustrates-(a) A schematic depicting the trumpet tubing terminal associated with the gas entrainment diversion tubing of the well bore as also of the marine riser, to be conjoined with a down-turned inlet tubing of a subsea gas-oil receptacle, said articulation accomplished by a sliding screw arrangement; (b) A schematic of said inlet tubing shown to be opening into a water tank within the gas-oil receptacle.

Figure 4:
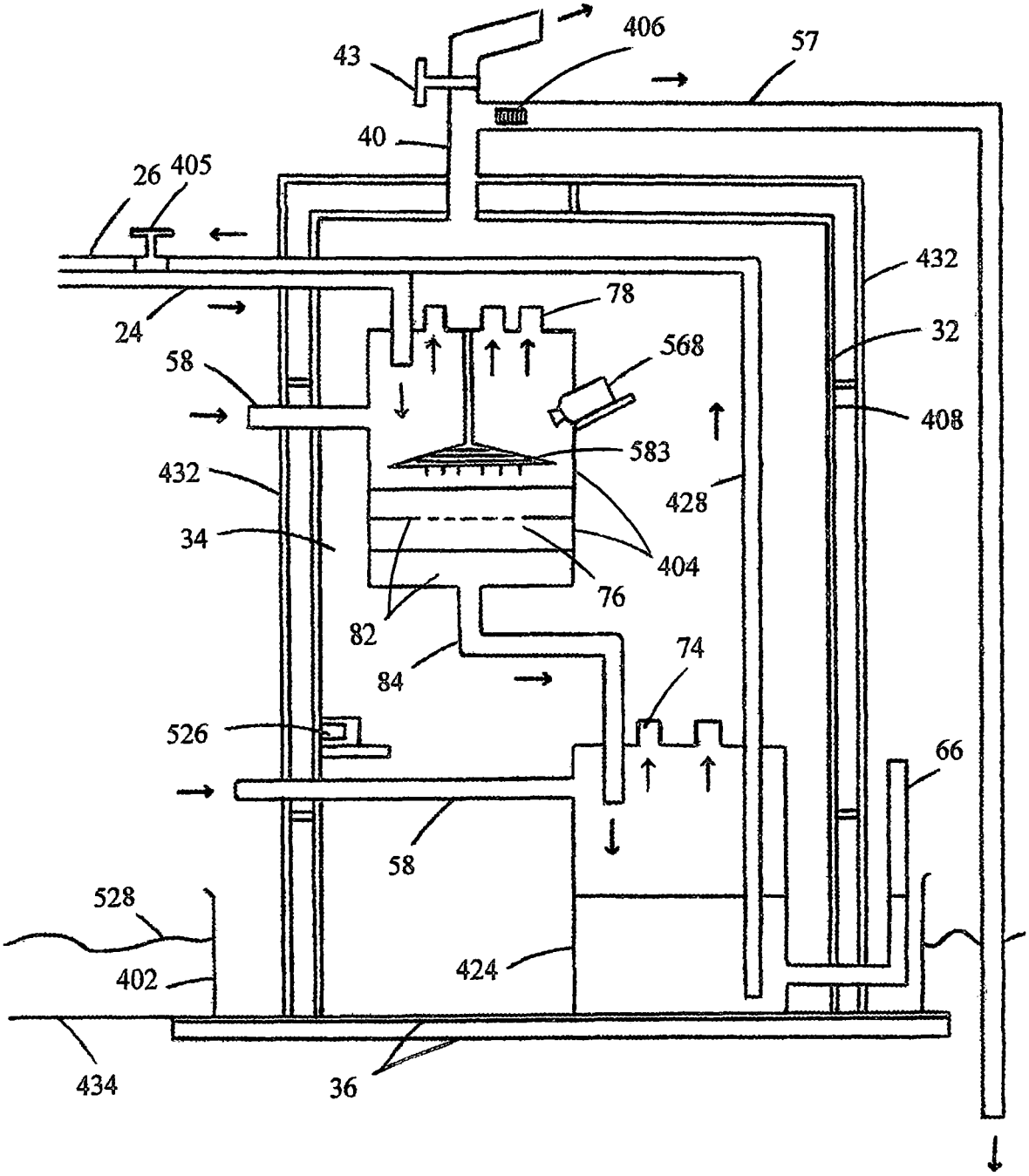

FIG. 4: The drawing illustrates-A schematic of a prototype 'Sea level gas separator of oil well effluent unit', depicting: (a) a structuring facilitating the flow principles of separating the components of gas from liquid and semisolid crude of petroleum analogs; (b) A schematic of structural measures required for the oceanic diversion of the pressured gaseous elements; (c) A schematic of an incorporated 'Spiked circle dispersion device'—to disrupt the semisolid effluent blocking the flow from a gas separator tank of the 'Sea level gas separator of oil well effluent unit'.

Figure 5:
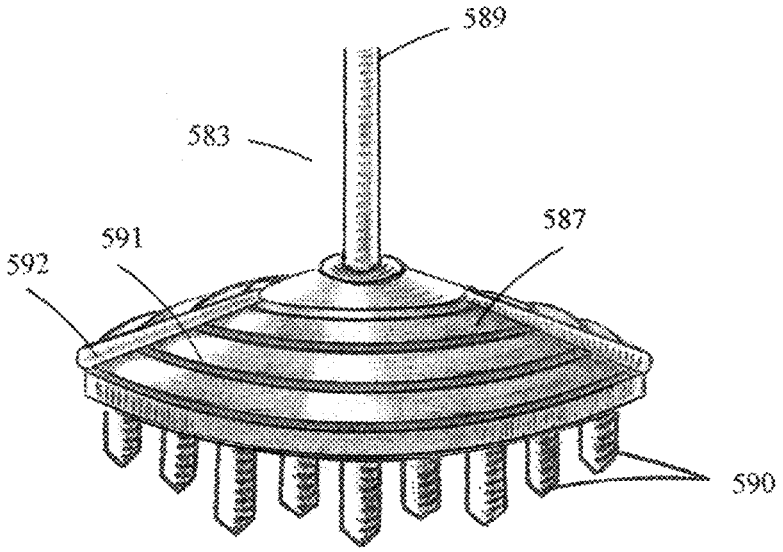

FIG. 5: The drawing illustrates-A perspective view of a 'Spiked circle dispersion device', a model to be incorporated in a gas separator tank of the 'Sea level gas separator of oil well effluent unit', the device configured to disrupt the semisolid effluent blocking the out flow.

Figure 6:
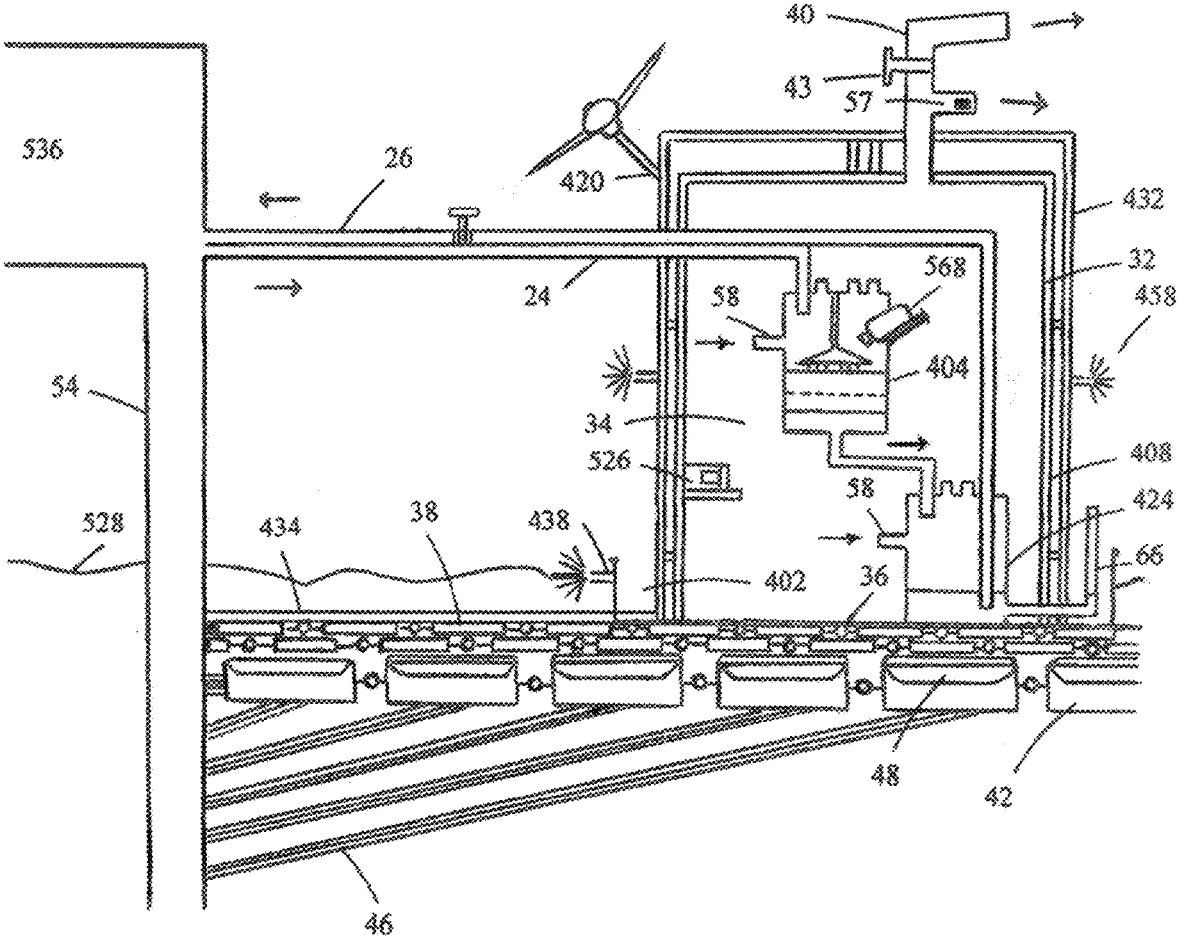

FIG. 6: The drawing illustrates-A schematic of a 'hammock model' for a positional disposition of a 'Sea level gas separator of oil well effluent unit' about the rig vicinity.

Figure 7:
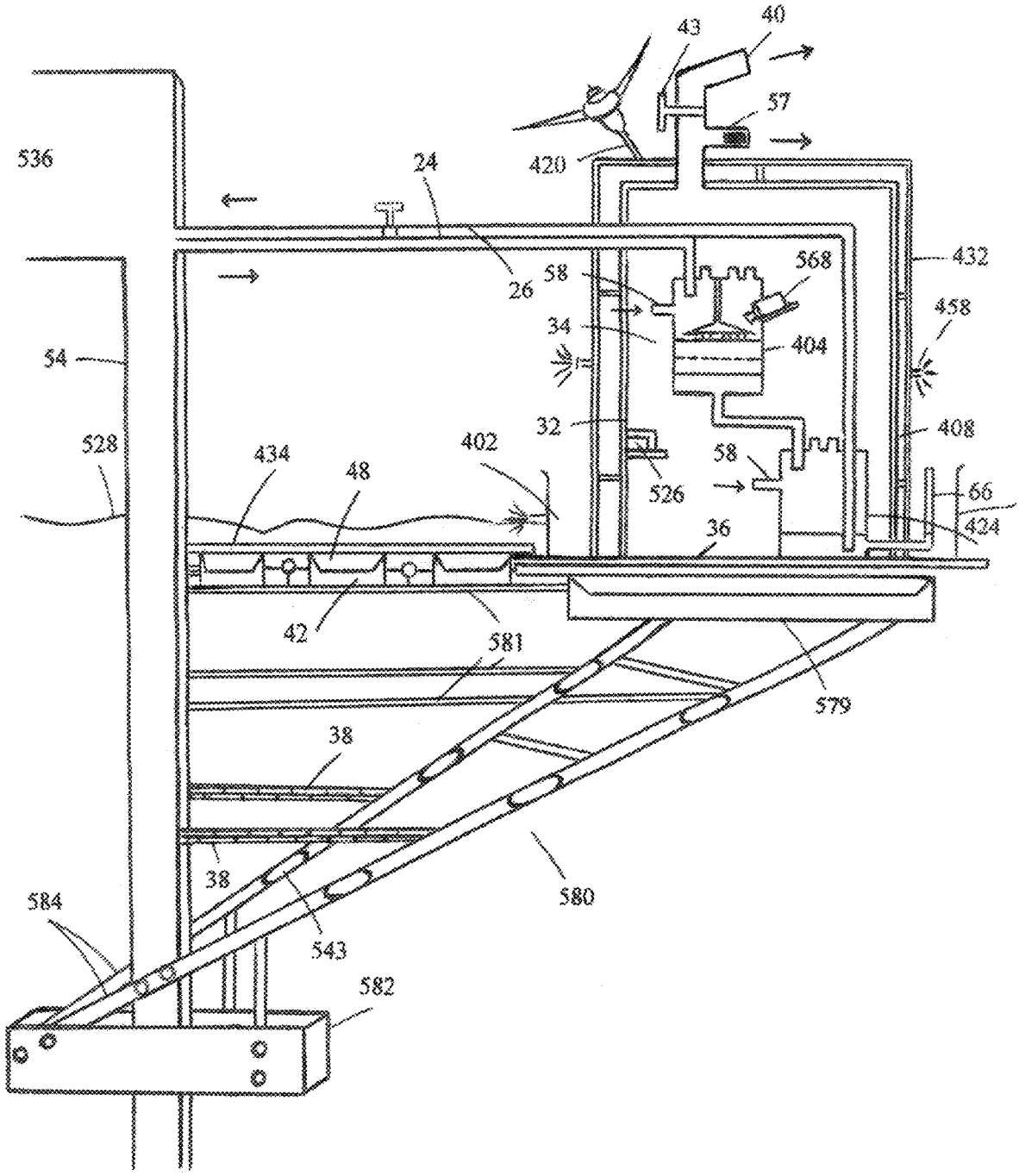

FIG. 7: The drawing illustrates-A schematic of a 'submerged anchor base model' for the positional disposition of a 'Sea level gas separator of oil well effluent unit' about the rig vicinity.

Figure 8:
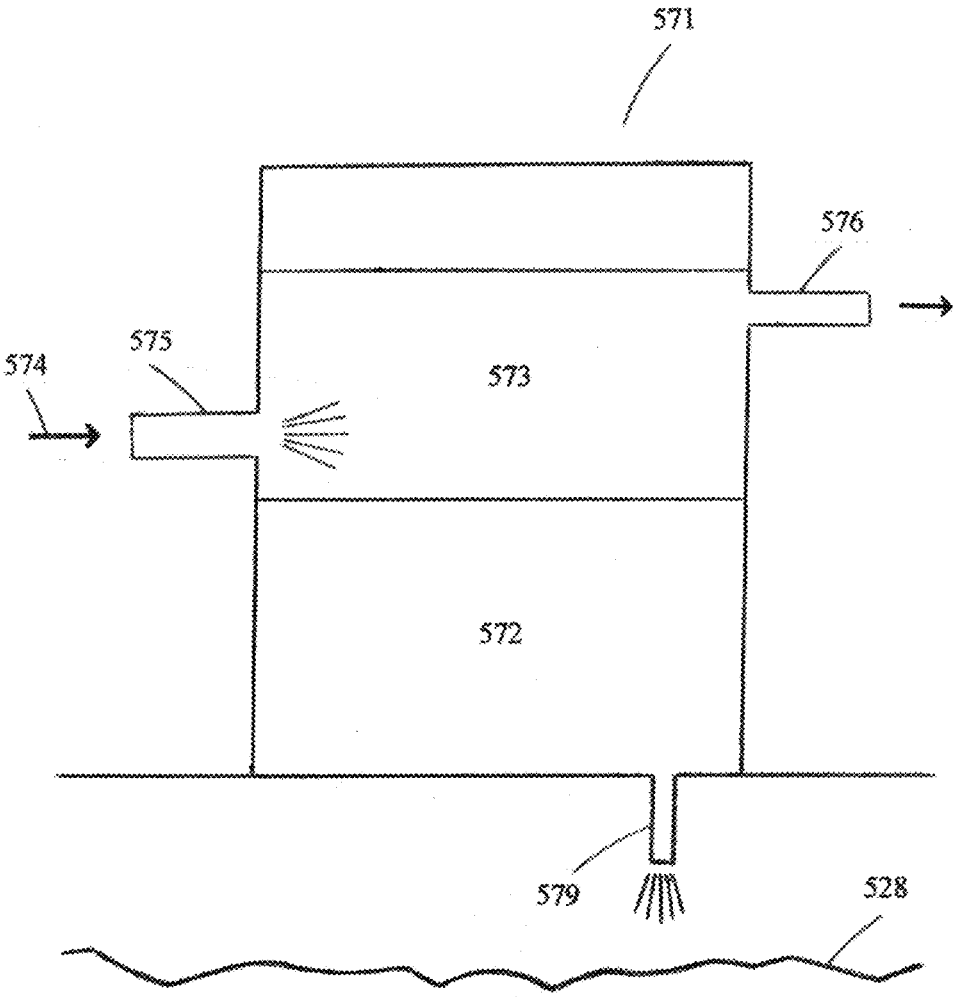

FIG. 8: The drawing illustrates-A schematic of an 'Oil separator tank of water admixed well effluent' that separates oil from the water admixed effluent.

Figure 9:
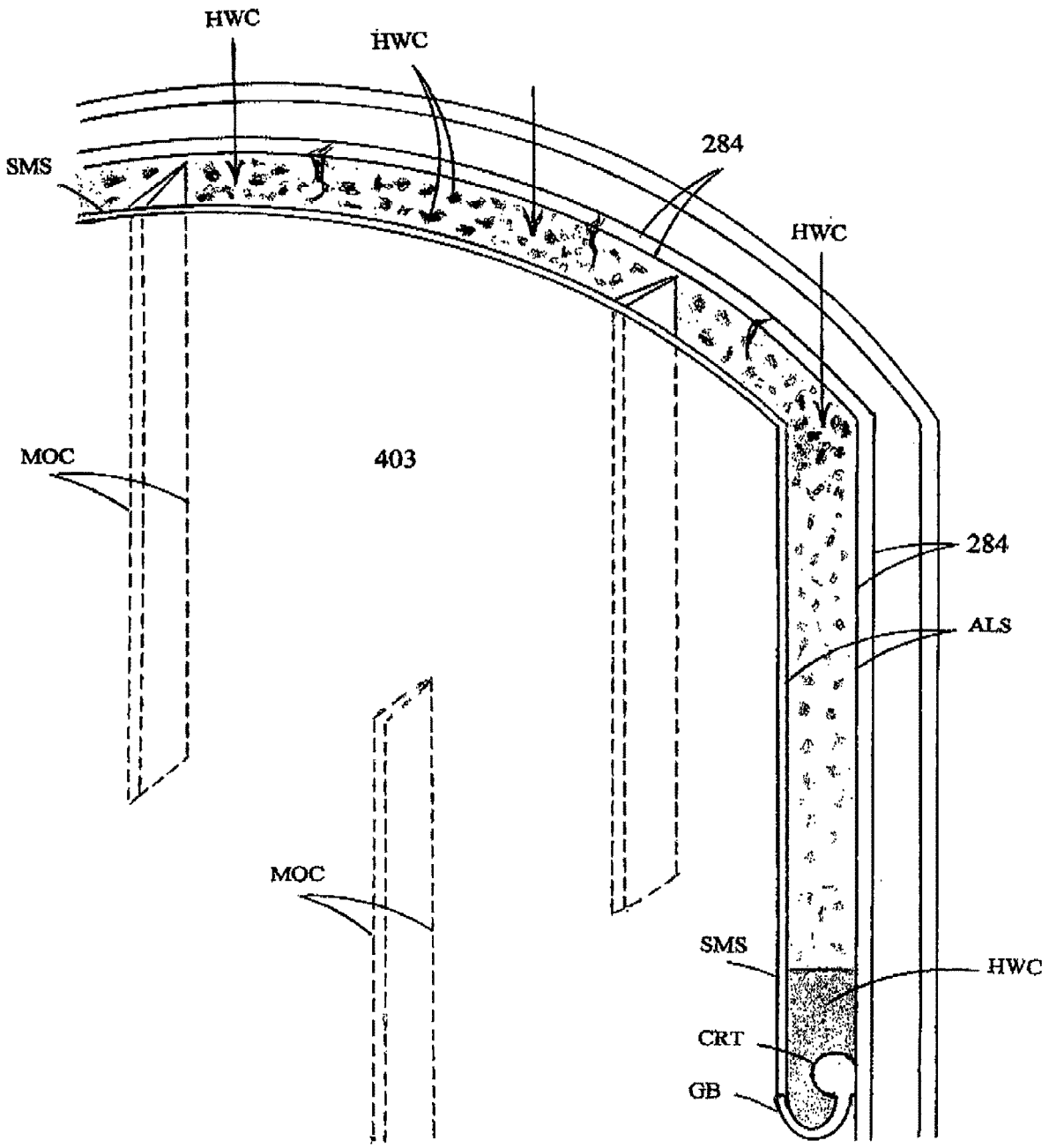

FIG. 9: The drawing illustrates the schematic of a metal sheathing, lining the breached innermost casing of a blown out oceanic oil well, the sheath showing-(a) the mold-on centralizers functioning like spacers to provide the 'standoff' required of the metal sheathing, said centralizers configures as vertically dis-positioned blade-like structures of the metal sheathing facing the innermost casing; (b) a bottom gutter like outwardly directed cement-holder with a rubber washer terminal that is devised to butt against the innermost casing like a casing-shoe, thereby precluding the spillage of the cement into the well bore; (c) annulus like space wherein cement is instilled.

DETAILED DESCRIPTION OF THE INVENTION

As was earlier briefed, the present invention is drawn to a model for the 'Well Bore to Oceanic Diversion of a Gas Entrainment' aimed to prevent a well head blow out, the inventive concept being accomplished by a devised 'Well Bore Gas Entrainment Diversion Tubing' (WGDT) (FIGS. 1A & B). Despite such provision, if a well head blow out happens, the gas entrainment emerging into the Riser pipe, is precluded to reach the rig level, being yet diverted into ocean waters by a Riser Gas Entrainment Diversion Tubing (RGDT). Both WGDT and RGDT incorporate one way valves so as there are only effluent let-outs into the ocean waters, but no let-ins of the ocean waters.

A device of 'Sea Level Gas Separator of Oil Well Effluent' (SLGOE) unit (FIG. 4) is also positioned in a rig vicinity, the SLGOE unit's function being initiated upon conclusion of the functions of the WGDT and RGDT in the setting of a well blow out, whereas its function can be optionally elected to prevail on a regular basis also, for oil-gas separation in a controlled manner at the rig level, so as the practice of flaring can be safely and slowly weaned off by the oil companies. As the SLGOE unit conforms to be a vital part of the oil collection-gas separation system, it is protected in a modular capsule, that additionally has multiple fire protection components.

An effluent is generally defined as an admixed formation of an underground oil containment, substantially in its natural form, containing gaseous hydrocarbons like methane and the liquid and semisolid crude of petroleum analogs, emanating with or without a conduit tubing. The scheme of oceanic diversion of a highly pressured gas entrainment is incorporated into the system during a predictable time, as about the time of the down hole completion. The fractionated and subdued effluent can be collected into gas-oil receptacles that are kept readied in all instances, in anticipation of an event. The afore mentioned one way valves of the diversion tubing can allow outflows only as long as the effluent is pressured. Hence, when the effluent's pressure is optimized and the valves allow no out flows, the oceanic Gas Diversion Tubing (GDT) are capped, and the effluent is diverted into the Effluent Diversion Tubing (EDT) that enters the well's oil collection system that reaches the SLGOE unit for an oil-gas separation, initially by-passing the rig, either oil is collected via the SLGOE unit occasionally (as after a pressured entrainment) or as a routine. The production tubing when installed, is structured to also join the well's oil collection system. All the tubing of the well-rig system are built with provisions for possible interconnections in strategic places. If an oil company refrains from routine oil-gas separation and gas collection, the SLGOE unit will not be a part of the rig's oil collection system after an uneventful down hole completion.

The invention also envisions reparative measures for breached well bore and marine riser that are simple and more often successful.

Well Bore to Oceanic Diversion of a Gas Entrainment

FIG. 1 shows the schematic of diversion of a pressured gas entrainment from a well bore to oceanic waters, which is simple in its operation, and contrastingly different from a basic model of extreme pressure control valve as envisioned in the conventional Blow-Out-Preventer (BOP). The herein devised scheme is not to resist a gas entrainment under tremendous pressure, but to instantly dissipate it, by means of total diversion into ocean waters, said difference pursued, because the pressure-control by the BOP at times failed, and had let out inflammable gases into the rig confines, as in the Deep Water Horizon Oil Well blow out. Such pressure control valves are ingenious inventions, however, in certain set ups as the oil wells, occasionally with immense pressures not elsewhere encountered, the pressure-check valves inherently lack provisions to resist such pressures. The valves are probably better suited to resist pressures originating from within narrow caliber conduits, such as a 'production tubing', at least in few instances of unexpected pressures. However, when the innermost casing conforms to an oil conduit, as was in Deep Water Horizon oil well blow out, the needed resistance of BOP to be exerted in this instance, is against a well containment under immeasurable pressure. Most, though not all BOP failures probably happened/happen under such circumstances, if not for unrecognized technological failures. Hence, it is prudent that yet another mechanism in conjunction be set forth in place, to mitigate BOP failures and the resulting catastrophic events, the latter being the so far insurmountable 'situational calamities', that will continue to prevail about the time of down hole completion.

The Devising of 'Well Bore Gas Entrainment Diversion Tubing' (WGDT)

The Well Bore GDT, two in circumferential (geometrical) equidistance, and falling in any but of a same diametrical line, are devised to be constructed nearing well completion. The outlined plan is easily doable though the mindsets of the industry and its affiliates are not conditioned to such an endeavor, though soon they will be. In this disclosure, the terminology 'sea' and 'ocean' are used interchangeably denoting water bodies that surround the continents and also include gulfs and bays, while water bodies within, like rivers and lakes being not excluded. All plugs, sliding screws, and small or large tubing of steel used in this disclosure should be conforming to API 5 T standards. The vulcanized rubber must be a specialized elastomer to stand very high temperatures, like vulcanized silicone or Viton (both resisting temp up to 500° F.).

The Outlines of WGDT Structuring

The incorporation of the 'Well bore Gas entrainment Diversion Tubing' (WGDT) into the off shore oil well is illustrated in FIG. 1A not drawn to scale, the figure depicting a schematic of WGDT originating in the well vicinity about the level of the ocean floor and traversing the well casings and annuli in a slanted disposition, to be reaching the well bore. The WGDT encompasses a simple tubular design, its well bore termination set forth at a predestined distance from the well head. In compliance thereof with the figure, the following details the devising—

(a) An Entrainment Let out Tubing (ELT) of the WGDT—the ELT 17, is a large and stout tubing of steel conforming to API 5T standards, and originates about the ocean side to traverse all well casings to emerge into a well bore. Its ocean side origin is from a large bottom corner window 7 of a Modular Construction Chamber (MCC) 27 set forth on the ocean grounds. Though a straight tubing, it is slanted in its overall disposition, its ocean terminal set forth at a higher level. The ELT 17 from the window 7 reaches the exterior of the conductor casing 281 through a large inclined Ground Transmission Piping (GTP) 20 of steel, the latter connected to the conductor casing and the window 7 of the MCC by wide unruffled metal cuffs about either terminal. By a Casing Cuff of GTP (CCG) it is glued and taped over to the exterior of the conductor casing 281 to which the cuff is contoured, whereas by a MCC Cuff of GTP (MCG), it is glued and bolted to the outside of the window 7. As also, the GTP 20 is later embedded into the outer sea floor cementing of the conductor casing 281. The conductor casing, the thickest of the casings, made of high strength steel of API 5T standards, comprises in a same diametrical plane two circular openings with water proof closures, rather than the crew resorting to boring and tunneling it, for the WGDT deployment on either side. The openings are proportional to the elected diameter of the conductor casing 281. While it is a thick pull-out snapping closure of steel about the ocean side of the casing 281, about the well bore side, it is closed by water-proofed plastic, so that the ocean side snapping closure is not cemented during the slurry cementing by casing shoe, when the intermediate casing is hung in position. Other casings need metal drilling tools for initial burr-holing and later tunneling. With a predetermined incline with down slanting towards the well, the GTP 20 traverses the ocean grounds 282 (that was excavated about its superficial layers for the deployment of the conductor casing 281) and expands as it approaches the MCC window, such widening along with the large size of the window 7, allowing easy approachability of the well casing(s) when tunneling of the casings is endeavored. The deployment of the MCC 27 and the GTP 20 are done during the erection of the conductor casing as it is easily doable about this time, yet the deployment of the ELT 17 is done only after the cementing of the innermost production casing 284. At this later time, the WGDT Deployment Divers (WDD) from within the MCC 27, approaching through the opened window 7 and through the GTP 20, burrow a slanted tunnel 23 through all the casings and the annuli to reach the well bore 403 at a lower level. The ELT 17 of preconfigured length, about its lower well terminal is fitted with a GDT Flush plate 8 and Closure (GDTC) 475. The lower positioning of ELT 17 within the well bore allows a safe predestined distance from well head 510 set forth by well engineers.

(b) An Outgoing Entrainment Tubing (OET) of the WGDT-after cementing of the ELT 17 within the well casings, the ELT 17 articulates by a straight or an elbow joint with an OET 51 of steel within the MCC 27. The straight OET 51 as an outgoing tubing of preconfigured length, emerges from a bottom 'outlet opening' of the MCC 27 about a wall 42 positioned opposite to the corner window 7, the OET 51 articulating with a conjoining steel tubing 37 of the WGDT upon the ocean grounds. The MCC 27 as a water proof enclosure, can be made of metal.

(c) A rigid conjoining steel tubing 37 of the WGDT—a small conjoining tubing 37 connects the ocean side of the OET 51 to a terminal Inverted J Tubing (IJT) 5 of the WGDT.

(d) A rigid terminal Inverted J Tubing (IJT) of the WGDT-made of steel, the UT 5 stands vertically upon the ocean grounds in the ocean waters 252, and it incorporates one way valves 125 and an appended small horizontal segment (SHS) 540 about its down turned terminal (DTT) 509. It also shows in the drawings, an incorporated Effluent Diversion Tubing of the Well (EDTW) 430 that originates about its U curve.

Timing of WGDT incorporation into the well—it is timed to be soon after the cementing of the inner most casing 284 is set for a time period of 7 days, when burrowing can be safely pursued.

Detailing of the Modular Construction Chamber-so as to isolate ocean waters during the deployment of the WGDT about the well casings, a water tight minimally sized metal enclosure, as MCC 27 is set upon leveled ocean ground, wherein the well boring is commenced, the MCC rested 2-3 feet away from the outermost conductor casing 281 and stabilized by bolting to the ground at strategic places. It is possible that the bottom of the MCC at least partly gets cemented to ocean grounds. The MCC 27 comprises-caster wheels; an unbreakable locked glass door 33; about the interior, a corner bottom window 7 about a well side wall, with a water tight lockable closure; a bottom 'outlet opening' about a wall 42 positioned opposite to the window 7, and fitted with a water-proof snapping closure that is hinged to and falls to the bottom about the MCC interior; the ELT 17 and the OET 51 restrained in position; a built-in suction device; and needed construction supplies and tools about the top in a locked shelf.

The tunneling of the well casings—the WGDT Deployment Divers (WDD) get into the MCC minimally opening the door 33 of 4×1½ feet dimensions, that they close quickly after them. The flooded water is suctioned out. The tools and a sealed container of cement slurry in a closed shelf are positioned next to the window 7. Upon opening the MCC corner window 7, the widening GTP 20 buried in the outer cementing of the well is brought into view. Drilling a burr hole starting from the outermost conductor casing 281 is slanted down towards the well bore in a predetermined angle which is a linear continuation of the angle defined by the GTP 20. Configuring the directional course can be further done by simple engineering techniques as also by geological/archeological tools that the industry is familiar with, like Electromagnetic tracing devices, acoustic devices, or ground penetrating radar devices to point a directional course, as some deviation otherwise in any direction is an easier occurrence rather than not. If the usable imaging device is big and not easily portable to deeper oceanic waters, the device should be securely packed upon a high set wheeled cart, and immovably restrained to a wall of the MCC about a level the flooded water is not expected to rise. A dense spherical object can be hung in the center of the well, so as the sphere is positioned in a linear continuity from the predetermined level of the well side terminal, to serve as an aimed focal point. However, few degrees of imprecision is not detrimental as long as the well bore is reached without gross deviation. Mock practice of the burr-holing in a similar set up is worthwhile to perfect the technique, as gross mistakes in the real setting should be differed. However, the course of the burr hole within the casings and the annuli assumes a 'linear course' without great difficulty.

After the burr hole is found acceptable, it is expanded into a tunnel 23, making certain that its well side terminal is substantially smaller than the opening of a squared GDT flush plate 8 that the ELT 17 terminal is going to articulate with. The diametrical measure of the tunnel and the WGDT are elected based on the size of the well, and choosing a maximum size feasible being always a good choice based on an enormity of the gas entrainment. Choosing another set of WGDT deployed in a same sitting at a lower level of the well, yet reaching an adjacent window of the MCC 27, is a future option based on the safety profile and perceived need for a higher WGDT caliber, by available cumulative experience.

The ELT deployment within the tunnel—after the completion of the tunneling, the WDD will maneuver the steel ELT 17 of straight configuration, however assuming a slanting disposition, through the corner window 7 and GTP 20, into the tunnel 23, to reach the well bore 403. By robotic arms, a squared GDT flush plate 8 with a broad rounded and threaded base tubing, is articulated with the well side terminal of the ELT 17, where after the GDT flush plate 8 with a GDT closure (GDTC) 475 is bolted to the innermost (production) casing 284 to which the flush plate is contoured. Soon after the bolting of the flush plate 8, the ELT 17 is cemented into the tunnel 23 using QUIKRETE, a hydraulic water stop cement, number 1126. A consistency of cement that can pass down into the slanted tunnel is preferred to ensure full covering of the ELT 17, creating strong uncompromised cementing through the well casements and the annuli, a possible traverse to a giant gas entrainment. The squared flush plate 8 further comprises vulcanized silicone about the under surface with an outer extension as an unruffled cuffing that is glued as also bolted to the innermost casing, so that the cement will not seep onto the casing and the well side flush plate 8 containing a locking device with remote controls.

The structuring of a WGDT closure about the ELT 17—the well side ELT 17 opening is set forth to be situated about a preconfigured safe distance from a well head. About the well's interior, onto one side of the rim of the flush plate 8, a hinged GDT closure (GDTC) 475 with a locking device is subject to closing the squared opening, whereas about an opposite side of the hinge, the squared rim comprising a complimentary locking component for the GDTC 475. The locking device of the GDTC 475 is devised similar to a locking device of a car door, opened by remote control, as also requiring another remote operation to be closed. The GDTC 475 is devised with memory to stay open when it is unlocked, and the hinged side of the closure is positioned towards the side of the well head 510 as also it opens to the side of the well head, so that it will not be in the direct path, to be forced shut by the pressured gas entrainment approaching from the opposite side about the down hole.

The locking and opening devices of the GDT closure 475 can be a combination of the following conventional models with also needed modifications—(a) the conventional automated door that opens wide and closes automatically after few seconds, whereas for the GDTC 475, another remote operation is necessary to close it, as it needs to stay open by memory; (b) the locking device of a car door or a car trunk that unlocks by a remote signal, whereas the GDTC 475 not only unlocks, but also opens wide by memory (like the foregoing automated door).

Completion of the exterior WGDT—at the conclusion of the cementing of the ELT 17 about the well casings and the annuli, the ELT 17 is cemented to the GTP 20 with quick setting cement of hand formed consistency, by which the WGDT deployment is made very secure about the ocean side. Following it, the ELT 17 articulates with the OET 51 by a stout metal joint in straight or elbow configuration. The OET 51 that is contained within the MCC 27 is positioned on the floor of the MCC. After proper adjustments in its disposition, its ocean side terminal is let out through the wall 42 via the 'outlet' opening with which the OET 51 closely approximates. While the opening is covered by absorbent mops, the well side terminal of the OET 51 is threaded into the stout metal joint that already articulated with the ELT 17 terminal. After full threading-in and proper joining, the OET 51 is cemented to the bottom outlet opening with quick setting cement in hand formed consistency. The minimal water inflow can be easily suctioned out. The OET 51 is either resting on the floor of the MCC 27, or any gaps are supported by wooden blocks or rock tiles to stabilize it upon the floor. By minimally opening the door 33 as before, the WDD can leave the MCC as the cement in all places is set in. Outside in the ocean waters, the closing cap of the OET 51 is removed, and its ocean terminal swiftly articulated with the conjoining tubing 37 brought to the site along with the IJT 5.

It is a mandate that the IJT 5 of sturdy steel should be positioned vertical on the oceanic grounds to facilitate the function of the one way valves 125 devised in its down turned terminal 509. To that effect, it is steadied on three legs of a tripod cemented on the oceanic grounds, for a firm unshakable footage. The junction of SHS 540 with the J tubing is devised to be a smooth curve rather than an acute 90° angulation, and additionally, the DTT 509 comprises an unbreakable glass window to ascertain the state of affairs with reference to the one way valves 125 following a gas entrainment. The area of IJT 5 deployment should be a leveled ocean ground, and should be considered as a possible work area.

The borrowing and cementing are done in continuum for any WGDT. The second WGDT about the opposite side of the well can be done immediately after the first one. Incorporating gas-oil sensors during the manufacturing of the innermost casing strings is a better option, or else, incorporating them about easily accessible well bore side of the top, bottom, and the midway string at the rig level, is another option that can be easily accomplished. The signal transmitters from the sensors can pass through the well head into the riser to reach the rig site, to ring gas alarms. The signals from the well bore gas/oil sensors can directly open the GDTC 475 within the well, as also the GDTC can be opened by remote controls from a Vigilance Squad (VS) stationed about the conduction platform.

For those preferring the MCC positioning at a deeper level rather than adjacent to the well head, by an elected depth of ocean ground excavation, the MCC and the GTP 20 can be positioned lower. The WGDT can be slanted, the degree of incline also elected by the oil company.

An easily doable future plan of WGDT construction will be encountered in a subsequent section.

Being a temporary structure, to be cost effective, the MCC can be made in PVC. As the oil companies and the hydraulic engineers specialize in underwater projects, they can also come up with familiar plans they usually employ, wherein there is no need for a MCC 27 and the ocean water can yet be effectively isolated from the prospective construction site.

MCC as a relay station—electromagnetic waves in ELF and SLF frequency ranges 3-300 Hz can penetrate sea water to depths of hundreds of meters and such means of signal transmissions are routinely used by submarines under water. If such provisions are not a routine to the oil industry, a communication channel via the MCC 27 is an alternative to transmission through the well head and the riser. The color coded out going-incoming signal transmitters accompany the ELT 17 being held in place by eyelet closures and embedded in the cementing of the ELT 17. The MCC 27 is built with all needed provisions, its color coded transmitters and other structural connections established upon its stationing. The MCC being an intervening station where from relay signals are transmitted, the wiring passes through a secure metal tubing, so that they are not damaged in oceanic upheaval or by a well blow out. Said metal tubing rising to reach the air gap, comprises few holdings to the marine riser. If there is a down hole blow out, there is much needed work and monitoring to be done for gas and oil collection upon the oceanic grounds, and the MCC 27 can serve as a storage area and a rest place with high-set sitting areas for the divers.

The Effluent Diversion Tubing of the Well Bore (EDTW)—the Effluent Diversion from the WGDT to a Sea Level Gas Separator of Oil Well Effluent (SLGOE) unit 34 through an 1 Effluent Diversion Tubing of the Well (EDTW) 430, is depicted in FIG. 1A. The SLGOE unit is located about the surface waters in the rig vicinity, its detailing soon to be encountered. The up going EDTW 430 of WGDT originates about the bend of the DTT 509 of the IJT 5, to be reaching the SLGOE unit 34. At its origin, the EDTW 430 is normally closed by a sturdy clamp that is opened for an up flow of the effluent to reach the SLGOE unit 34, at the conclusion of the WGDT functioning, and after electively closing the WGDT with the devised cap(s).

Sumathi Paturu's Basket—Pneumosphere Valve (The SPP Valve)

The FIG. 2, not drawn to scale, depicts Sumathi Paturu's Basket-Pneumosphere model of one way valves, or briefly called as Sumathi Paturu's Pneumosphere valve (the SPP valve), positioned within the Down Turned Terminals (DTT) 509 of the WGDT and RGDT. The one way valves 125 function to let out the pressured effluent from the well bore 403 and the riser pipe 280, but not letting in-flows of the ocean waters 252.

The FIG. 2 depicts the DTT 509 in ocean waters 252, wherein the one way valves 125 are positioned as a stack of two, their structuring being mostly identical (a single valve placement is not precluded after cumulative experience). The description is applicable to either, as also they are identically labeled. The one way valve 125 comprises a basket housing 228 of metal, wherein an air-filled pneumatic sphere 208 made of light metal is stationed. The upper pole of the sphere 208 by means of a stout metal chain 238 is anchored to the center of a diametrically positioned rod structure 258 within the DTT 509. The Basket 228 comprises a narrow upper end 230 and a broad lower end 204, both ends opening into the DTT 509, the DTT in turn opening into an uninterrupted water column despite a lengthy appended structuring (that is, the trumpets and the connected tubing, as will be noted in the next section), encompassing the effluent diversion into underwater gas receptacles.

By virtue of a narrow upper end 230, the basket housing 228 conforms to an inverted nested configuration, wherein the pneumatic sphere 208 is normally wedged into, by floating in the water column and occupying the open upper end 230 of the basket 228, the down turned vertical structuring of the DTT 509 facilitating such disposition. The sphere 208 is so sized that it shuts off the open upper end 230 of the basket 228 from the lower water column when it is in a position of floatation, and by its circumferential dimension, it also wedges into an appropriating dimension of the basket 228. Being air filled, such function of the sphere 208 is always facilitated by a continuous column of water distally, thus closing the riser and the well bore from inflows. However, a pressured gas entrainment or an oil gusher can forcefully dislodge the wedged spheres 208 as shown in the FIG. 2, wherein the two arrows hint an outflow of the pressured entrainment, and such outflow can continue until the effluent pressure optimizes.

The pneumatic one way valve 125 is a safe unfailing device that blocks oceanic inflows even if the ocean waters are perturbed. In fact, forceful ocean waters will make the valve closure more secure. It can be a concern that the sphere 208 and its chain 238 can be blown out by an entrainment. For that reason the upper pneumosphere 208 is made smaller so as it can easily pass through the upper end 230 of a lower basket 228, whereas the openings of the trumpets and their tubing are made far larger than the larger lower spheres 208 with the anchoring chain 238 combined. However, a blockage is a real possibility if the spheres 208 are dismantled and dislodged, and hence 4 tubing for each trumpet are the required armamentarium that cannot be minimized. An election of a single housing of one way valve is not differed if so chosen. As needed precautionary measure, as the well site gas alarms ring, designated crew divers should get to the sea floor to inspect the glass window of the DTT 509 to ascertain the state of affairs with reference to the one way valves 125, and if they are found to be expelled, the SHS 540 should be capped as soon as the effluent pressure seems to be slowing, as the ocean water can back flow through the unprotected DTT 509 kept open to the ocean.

The Gas Fractionation and Diversion into the Gas Receptacles

The gas entrainment though led into the ocean, will not pollute the aquatic ecosystem to any extent, the encountered gases like methane being insoluble in water. In a same token, a concern is legitimate that the giant gas bubble can rise from the aquatic depths into the surface 'air gap', again like a gas entrainment causing an explosive fire, having encountered the atmospheric oxygen, as also it can encounter an ignition spark in the rig. Hence, the giant gas bubbles are prevented to rise and pervade the air gap and the rig confines by diversion to distant destinations. It is materialized by a structural addition about the time a kick from the down hole emerges as a threat, the means encompassing a 'Gas Fractionation and Diversion Device' (GFDD) appended to the WGDT terminal. The GFDD comprises a large metal trumpet with a narrow proximal stem threaded to SHS 540, whereas a wide distal part comprises 4 large openings, wherein lengthy flexible metal tubing originate. The flexible tubing traverse the oceanic waters to different circumferential destinations of 40-70 meters, safely away from the rig. The tubing terminals are secured in place upon the oceanic grounds, or else let into gas-oil receptacles upon the ocean grounds.

Collection of Entrained Gas/Oil Gusher

Due to the present concerns of climate change and the knowledge that the pollution of the ecosystem by methane is far worse than that of $CO_2$, a plan can be implemented for the collection of the entrained methane. In the present time of energy crisis, interest in its use as fuel, is spreading, and hence, it may not be wasted whenever possible. In view of countless number of oceanic rigs that will be dug due to Russian oil ban, gas entrainment is more than before, anywhere in the world. However, some rigs can be reluctant to deal with a giant gas entrainment after a down hole blow out. They can at least opt to collect an oil gusher that follows, without letting it pollute the ecosystem. Based on expected options that people are inclined to follow, two variables are herein outlined.

Tackling only an oil gusher—a devised water sampling tube-upon slowing of the gas entrainment, a predominantly oil admixed effluent starts to emerge, and it should be noted by the crew. At least one of the trumpet tubing terminating into the distant destination carries along with, a water sampling tube (normally closed by a sturdy closure about its rig terminal) where from the ocean waters are sampled periodically (with a strategic initial pause) to note when the oil starts to flow. The timing of water sampling is additionally guided by the emerging gas bubbles becoming scanty or none, as recorded by a night vision video device installed nearby. It can also show the force of the oil gusher so that the crew can decide if the area is approachable to the divers. Diving emergently to the ocean floor to personally inspect the tubing terminals should always be considered. The divers must be in full gear to avoid any contact with the oil spreading in ocean waters. When the tubing are approachable, they are dislodged from the ocean floor and associated with the gas-oil receptacles as described below, wherein only oil collection is to be accomplished, the entrained gas being already let into the ocean. The effluent being fractionated into at least 8 divisions as also the entrained gas eliminated, the oil gusher is mostly attenuated, to be handled.

Tackling the oil gusher as also the entrained gas—in this instance the plan is to collect the fractionated oil and also the gas into herein specially devised gas-oil receptacles. For it to be effectuated, unlike the earlier plan, it is required that the WGDT terminal is associated with the devised gas-oil receptacle about the time of down hole completion, when the trumpet tubing are incorporated. It is cost effective that the receptacles are rented rather than owned. It is anticipated that the enormous pressure is mostly attenuated by dividing it into at least 8 fractions, as afore mentioned. Those aiming this plan should consider as many fractionations as possible, by using enormous trumpets and more tubing. As per the mechanics of the WGDT one way valves 125 (the Basket-Pneumosphere model of the one way valves, as in FIG. 2) noted earlier, it is clear that the terminals of the trumpet tubing should be submerged in water (fluid) to effectuate the function of the valves. Such plan is materialized in the gas-oil receptacles described below.

The gas-oil receptacles—the schematic of a gas-oil receptacle is illustrated in FIG. 3. Each open trumpet tubing terminal 548 conjoins an inlet tubing 564 of a gas-oil receptacle 570 by a sliding screw 581 arrangement, wherein the inlet tubing 564 enters the bottom water column 519 of a wide enclosed tank 520 within the receptacle 570, the tank 520 having an outlet 560 situated in an opposite side about the top, wherefrom the gases rise into the gas-oil receptacle 570. In the former instance where only oil collection is opted, the trumpet tubing terminals after being dislodged from the ocean floor, are conjoined with the gas-oil receptacles with a 'sliding screw' arrangement. The inlet tubing 564 is sized similar as the trumpet tubing terminal 548, and even if the blown out pneumospheres 208 from the WGDT enter the tubing, they are easily flushed out into the wide tank 520 within the receptacle 570. If there are any water splashes within the tank 520 due to the pressured gas entry, they fall back into the tank, the tank outlet(s) 560 being positioned at the opposite end. Hence, the water is unlikely to get out of the tank 520 and all of it is mostly saved, an essential requisite for the intended function of the valve 125. About the opposite side of the gas-oil receptacle 570, the risen gases emerge from a gas outlet 544 about the top, to enter the land gas collection system, as also they can enter a devised oil outlet 524 about the bottom of the gas-oil receptacle 570. As the gas emerges into the water column 519 of the tank 520, its pressure is deemed to be further subdued, because—it spreads into a wider area of open body of water; it spreads into larger area of the gas-oil receptacle 570; it is let out continuously. The crew must be aware that the valve 125 closes when the effluent pressure optimizes.

The receptacle has a glass window 400 and an 'on-off' solar powered high voltage light that beams towards the inlet tubing 564, so that the gas flow can be visualized from the window 400, as also from a video device placed inside or outside near the window. The receptacle(s) 570 are brought down to the ocean floor with the inlet and the outlets capped. It is a reasonable plan that the trumpet tubing are positioned more towards the shore, to facilitate an easy traverse of the land lines to a coastal area.

The oil gusher—the WGDT can also divert an enormously pressured oil gusher from the well bore, and as per the fore going plan, the pressured oil gusher also enters the subsea gas-oil receptacle 570 to collect in the tank 520. A devised oil outlet 524 about the bottom of the gas-oil receptacle 570 that also had let out the gases earlier (a fact that the land crew must be aware of), will lead into the land line oil system. During oil collection, the water tank 520 of the gas-oil receptacle 570 may be submerged, but it will not adversely affect the function of the intended oil collection from the gas-oil receptacle. The oil is admixed with some water though water stays in the tank 520 mostly, as less dense oil overflows. In that manner the gas-oil receptacle 570 separates gas, oil, and water to a reasonable extent, an unique function easily achieved. The multiple and massive land receptacles in the coast are kept empty and their outlets clamped, so that the system as a whole is a secure closed system. An emergency signal must reach the land for a close watch by a specially assigned vigilant land crew about this time.)

Note—when the water level within the water tank 520 is at a lower horizontal level of the sea floor compared to the level of any of the pneumospheres 208, the water column will not reach the level of the pneumospheres at all, thereby preventing the water inflows, whereas if the water column reaches the pneumospheres 208, the latter stays afloat, also blocking the water inflows. That is, in any case, the inflows of the sea water into the well bore (and the riser) are precluded.

The temperature of deep sea being an average of 4° C. (at 200 meters and deeper), and the gas-oil receptacles maintained at that temperature, can aid in lowering the temperature as also the pressure of the gases, making their land line diversion safer than it can be otherwise (the pressure in a gas containment is directly proportional to the temperature—the Gay Lussac's law). Heat (the ignition source) is one of the requirements in the fire triangle (others being oxygen and fuel), the common heat/ignition source being any of the following—sun, hot surface, sparks, friction, or electrical energy; water stops fire because it takes away heat; gasoline and oxygen are present in an automobile tank, but combustion does not occur as there is no source of heat. To make a note, the temp of a subsea petroleum oil reservoir can be as high as 300° C. (the temperature of the emerging gases being the same, and the pressure proportional). Despite such high temperature, collection of a pressured gas entrainment is made fire-safe in a colder deep sea at 4° C. A further traverse of the gases through land lines of the sea floor at 4° C. also helps to lower the temperature.

Prompting the crew—the event of gas entrainment is prompted to the crew by gas sensors set forth about the down hole, the well's midway, as also near the GDTC 475, triggering gas alarms in the rig, the devising subject to a mandate nearing the time of threatened kick about the down hole.

The crew can view the gas receptacles through high set lighted glass windows, as also through a video monitoring device about the window, and when the gas bubbles emerging from the water tank of the receptacle cease, the oil outflow commences and an oil gusher can be viewed and identified.

The effluent diversion into a primed milieu of the SLGOE—when the pressure optimizes and the one way valves 125 allow no out flows, the trumpet(s) are disarticulated and the WGDT terminal(s) capped, while the EDTW 430 is unclamped for the effluent to flow into the SLGOE unit 34 (FIGS. 4, 6 and 7). The up-flows through the EDTW 430 is effectuated in a similar manner it is done when the production tubing functions as the well's oil conduit.

As the unclamping of EDTW 430 is an elective event, it can be properly yet swiftly planned so as the tanks of the SLGOE unit 34 are filled with oxygen-free atmospheric air. An explosive fire can be possibly averted, when inflammable gases under pressure enter the oxygen-free milieu of the SLGOE unit 34, its devised structuring for the purpose being encountered in a latter section. Understandably, the tanks of the SLGOE unit 34 are not in a temperature milieu of 4° C. as the gas receptacles of the ocean floor are, and hence best precautionary measures are instituted.

No minimalizing the armamentarium—4 tubing from each trumpet is the minimum needed even for a small well. In case the two valves 125 that are incorporated into the GDTs are blown out by a pressured effluent thereby blocking two of the tubing (however, the valves are designed to prevent a blockage even if they are blown out), at least there must be 2 on either side that are certain to function, to let out the gas entrainment and possibly an oil gusher that follows.

The Subsea Diversion of a Gas Entrainment by the Riser's Gas Entrainment Diversion Tubing (RGDT) (Sumathi Paturu's RGDT)

It was earlier noted in the section of 'Brief Description' that despite all the measures to prevent a well head blow out, nature's wrath can be uncontainable, and a well head blow out may still happen. In the same token, all the well bore gas sensors may be blown out or the well bore signal transmission become dysfunctional without eliciting a gas alarm in the rig confines. Hence, it is a wise choice that gas and oil sensors are also incorporated at different levels of the riser pipe 280 (FIG. 1A) during manufacturing, as at least the sensors of the upper half of the riser 518 are subject to stay intact in most instances, to ring a rig alarm (these sensors can directly reach the rig from the riser without a need for oceanic transmission). They are covered by vulcanized 'silicone shielding disc' during the time of well digging, wherein the disc is cut by a robotic arm after the well drilling is concluded. In this rare instance, a part of the pressured entrainment that finds its way into the marine riser, should also be diverted into the ocean waters, to circumvent a situation culminating into an explosive rig fire.

The bottom strings of the riser 518, as close to the well head as feasible, are devised to incorporate the above specified RGDT, two in number, in a same diametrical line in circumferential equidistance. If two of the WGDT are positioned about north and south, the RGDT are positioned east and west, so that the RGDT is not in the direct path of an entrainment, in case there is a blow out of the emerging WGDT near the well head. The RGDT can be of smaller diametric dimension than the WGDT, because it has to be accommodated in the riser's outer space. Hence, they are devised to be more in number positioned at different levels of the riser.

Few strings of the riser are manufactured to incorporate the RGDT, the latter originating from the riser pipe. Though the RGDT traverses the riser's outer space, it establishes no luminal communication, and is exteriorized in entirety from the riser's outer auxiliary 'power' and 'control' lines so that their functions are not interfered with. The RGDT originating from the riser pipe is structured as a flexible metal tubing, whereby its course is maneuvered easily through the riser's outer auxiliary 'power' and 'control' lines. The origination of the RGDT accommodates GDT closures that mirror the well's GDT closures in their locking devices and are opened about the same time, wherein the signal transmitter can pass from the rig into the riser pipe, being operated by the VS. Past the riser's outer boundary, the RGDT comprises a J tubing, the J tubing not devised to be flexible. After coursing horizontally 3-4 feet, the J tubing makes a down turn, said down turned terminal (DTT) incorporating a short horizontal segment (SHS) normally capped until about the time of down hole completion, when the trumpets and their tubing are deployed about the RGDT. The junction of the SHS with the J tubing is devised as a smooth curve and not a 90° angulation.

The downturn of the J curve incorporates one way valves that allow outflows of the pressured entrainment but the inflows of the ocean water are wholly blocked. The mechanics of the one way valves are similar to those about the DTT of the WGDT.

It is an option and not a mandate that the RGDT is structured also about the midway of the riser and additionally about their top strings. The RGDT at different levels are configured because these tubing are made of narrow caliber to traverse the limited riser space, and yet to be effective in situations when the outflows from the riser are also voluminous and should be precluded from reaching the rig confines. For the reason that the entrainment is being let out instantly through the RGDT, the riser and its vital structures are protected from an otherwise more damaging breach A Gas Fractionation and Diversion device—a Gas Fractionation and Diversion device with trumpets and incorporated tubing, are appended to the RGDT about the same time they are deployed about the WGDT terminals, their structure and function identically devised. As was specified in the descriptive section of the WGDT, minimizing the armamentarium to less than 4 tubing from each trumpet, is differed in this instance also.

The oil collection from the RGDT—the issue of oil collection through RGDT arises only in the event of a well head blow out, when the effluent can enter the riser pipe, despite the fact that most of it will be let out by the WGDT. Accordingly, RGDT is equipped for oil collection in a similar manner the WGDT is equipped with, following giant gas entrainment, as was already discussed in the context of the WGDT. That is, the effluent from the RGDT is ultimately let into the gas-oil receptacles and land collection system. The Effluent Diversion Tubing of the Riser (EDTR) will also enter the tubing of the oil collection system to reach the ultimate destination of the SLGOE unit 34 for oil-gas separation. If the effluent out flow from the EDTR is not as voluminous as the effluent out flow from the EDTW, using one or two outlets can be sufficient.

A LAST ANXIETY DISSIPATING SOLUTION—the whole project of oceanic diversion of the entrainment from the well bore and the riser pipe being a daring proposition, one has to think in terms that steel and cement make up world's strongest structures including major bridges on which innumerable cars pass every hour without causing damage. Accordingly, implementation of the plan wherein the imposed structures are steel and cement, is strongly encouraged, though it cannot be denied that it would be immensely anxiety provoking. Hence, an anxiety dissipating proposition is—as the major events are predictably about the time of down hole completion, soon after an uneventful down hole completion, the WGDT and RGDT are wholly undone by dismantling and cement sealing.

The capping of the GDT tubing—the threaded terminal of SHS 540 (which is the articulating junction of the trumpet) comprises an affixed cap hung by lengthy chain to seal the terminal when elected. If the 'cap head' with an affixed chain to the head top closes clockwise, to start with, the chain is twisted on itself to make 5-6 turns anti-clockwise, and then the cap can be easily screwed on to the threaded SHS terminal.

Concluding Comments about the Foregoing Sections—

Despite the foregoing schematics, the nature's wrath and the enormity of a gas entrainment may far exceed all human limitations, and at least a part of the pressured entrainment may reach the rig site. Hence, it is a proactive choice to have all gas/fire safety measures in a rig as if the above plans were not instituted. The devised schematic is not without benefit, that is—the enormity of the entrainment and the number of adverse events are substantially minimized. In other words, they are controllable and amenable to human interventions, to prevent/stop a rig fire that may otherwise be unstoppable and catastrophic. The fire countering measures within the rig are mostly enumerated in a contemporary CIP application 'Off Shore Fire Escape Devices including Sinking and Rising of a Detachable Island Rig' (U.S. Ser. No. 17/803,373) of the Inventor, and there are plurality of measures otherwise operative, as in the cross referenced U.S. Pat. No. 9,175,549 by the Inventor also, and they need to be consulted, said measures working in synchrony.

A Possible Future Project of WGDT Construction

The WGDT Construction with Casing Passways (WCCP)

It is natural that people in any project seek less elaborative pursuits whenever possible. The same holds good in constructing the WGDT, which in the foregoing model, cannot be denied as being elaborate, at least in the context of deploying two MCC about the well site. It is so devised for the reason that the Inventor had to restrict the available avenues with the available tools of the industry as they are, because structurally changing any standard equipment is a Herculean undertaking in an industry like off shore oil wells with stringent standards. However, after proven success of controlling a gas entrainment with the foregoing model, and such stringent outlook can be relaxed and minimal structural changes during manufacturing of the well casings considered, there will be no elaborate work or expense for the oil companies. It is not entirely a new idea as such measure was already advocated for the GDT of the marine riser, which is the RGDT, described in the foregoing sections.

The new designing of WGDT Construction with Casing Pass ways (WCCP) is as follows:

Well head access—once a casing is hung to the well head 510, its outer annulus, cemented or not, is closed. For that reason, to yet gain access to outer annulus of a casing, temporary snapping flaps, two in a same diametrical plane, with sizes standardized based on elected diametrical size of WGDT, must be devised about the well head components of top strings during manufacturing. For safety, they can be permanently sealed after desired function is accomplished. To let out a giant entrainment, it is wise to elect a large diametrical size WGDT, and a slightly larger well head flap.

The overall WGDT structuring—the WGDT in this context is also slanted, with its well side terminal is set lower and ocean side terminal reaching ocean floor adjacent to well head 510. The incline also allows a flexible segmental configuration of Individual WGDT Components (IWC) to be longer. Optimally sized Circular WGDT Openings (CWO) of top strings, two in same diametrical plane are made also during manufacturing, to allow passage of the IWC from outside the conductor casing to the well bore, spanning all the casings and the annuli (FIG. 1B).

Individual WGDT components-radial dimensions of annuli though small, wider diametrical WGDT components are yet possible except their length within the annuli is limited despite a slanted disposition. Hence, the IWC are made as duct tubing for maneuverability and adaptability, and they are constructed by coating vulcanized silicone rubber upon silica fabric (96% pure Si $O_2$ woven into flexible textile, or derived from fiberglass removed of impurities) (to resists temp up to 500° F.), with thin steel spring wire to prevent collapse. To be soon cemented around, durability is not an issue.

The IWC comprises wide Steel Terminals (ST) of sufficient lengthwise dimension to be fitting over Receptive Steel Tubing (RST) of the casings on both sides within an annulus, said RST having a nested configuration with the annular side having a narrower dimension. The Nested RST (NRST) configured like a wide but short bottle neck, is mounted onto a ring like Flush Plate of Steel (FPS) with water-proofing of its undersurface by vulcanized silicone rubber lining that further extends out like a Circular Unruffled Cuff (CUC) of 2 cm radial dimension, the silicone rubber coated all through the under surface with dried commercial grade plumber's glue. The FPS is contoured to and bolted to the casing (that has required burr holes) around the casing's CWO. Based on the type of casing to be deployed, one or both FPS along with the NRST can be bolted by the crew at the rig level on one or both sides of the CWO of a casing, which is similarly done in the opposite diametrical side of the casing. It is easily accomplished, as the FPS are near the well head. Centralizers may not be needed in this instance, except at the lower ends of top strings, as WGDT within the annuli provide optimal 'standoff' about the top. The individual casings are dealt with in different ways, as follows—

(1) The intermediate casing 512 (as also a surface casing) is amenable for bolting FPS (along with the NRST) on outer as also well bore side of CWO on either of the opposing diametrical sites, done at rig level, prior to casing 512 is hung. The bolting of outer FPS members is plain and simple, whereas the bolting of the inaccessible well bore side FPS members needs extra planning, as follows.

Well bore side FPS (with the NRST) bolting—this is done before the outer FPS members are bolted. It is for the reason, that one of the well bore side FPS, for instance, a member numbered as 1, is bolted by accessing the well bore side through the CWO of the opposite diametrical site, assigned for well bore side FPS member numbered as 2. However, the CWO of the bolted member FPS 1 now being closed for a similar access, the FPS member numbered as 2 about the well bore side can be only bolted by a robotic arm, wherein the robotic arm has variety of vision guided end effectors, approached through the closer well head side of the top string. The well bore side has bur holes pre-configured at 3, 6, 9 and 12 O'clock positions. The well bore side NRST also need additional protection, as after the casing is hung, by continued drilling, drilling fluid and rock cuttings flow through well bore, and can block NRST tubal lumen. For that reason, a double layer of vulcanized Shielding Silicone Disc (SSD) with a smooth imperceptibly risen disc contour, stretches across the circular space of FPS (as the inset; main figure shows CSD, the cut SSD), covering the NRST on either diametrical side, until production casing is in place, and IWC of annulus B is to be conjoined.

The bolting of outer FPS—bolting of either of the outer FPS (with NRST) can commence now, and wholly done by the crew. The FPS are bolted with burr holes already placed in between those at 3, 6, 9 and 12 O'clock positions of the inner side. The outer NRST is also fitted with ST of the IWC at this time about the rig site, the conjoining sealed by cement of hand formed consistency.

As the cement is cured for 48 hours, the intermediate casing 512 is hung, and either of the free outer ST of the IWC held by long Dyneema twines are fitted in turn upon the NRST of the conductor casing 281 (wide infra) within the annular space by a robotic arm. To effectuate that, both layers of the SSD of the well bore side FPS (comprising NRST) of the conductor casing 281 are cut about the inner circumferential dimension of the FPS, to expose the NRST. It can be obvious that the well bore side of the conductor casing, also exposed to drilling fluid and rock cuttings after it is hung, must comprise similar structuring of SSD covered NRST. The NRST of the conductor casing being coated with dried up glue, by wetting with water, it makes a stronger bonding with the cemented ST about the IWC of the intermediate casing. Thereafter, the intermediate casing 512 is cemented by pumping cement slurry into the annular space AS via the casing shoe, by which the ductal IWC along with the conjoined ST on either side, is cement embedded. Inferentially, among 4 FPS bolting done to each casing at the rig site, 3 are done by the crew, as also the conjoining of the ST of the two IWC segments to the outer NRST of a casing, about to be hung.

The vulcanized silicone is also abrasion resistant. The plan mostly done in the rig is assuring, and done otherwise can only be deemed harder as also the needed safeguards beset with uncertainty.

(2) The production casing 284—it comprises only an outer FPS and NRST bolted about the CWO of the casing at rig level, while also the NRST are fitted with ST of the IWC that are further sealed with hand formed cement. As well digging is no more pursued after the production casing 284 is deployed, the SSD covered well bore side FPS of other casings is herein replaced by GDT flush plate 8 with GDTC 475 (as the foregoing model) and is also bolted at the rig level about the same time, and the conjoining further cement sealed, in place. Obviously, bolting of one of the GDT flush plates of the well bore is handled by a robotic arm. The cementing of production casing 284 by casing shoe is done after well bore side SSD about the FPS of the intermediate casing 512 were cut by robotic arm on either side, and the ST of the IWC glued over to the exposed NRST of the casing 512.

(3) The conductor casing 281—obviously, the proceedings start with the conductor casing 281, as it is the first to be deployed. The casing about the ocean side of the CWO comprises a large Up Slanted Spout (USS) that is capped. About the time the conductor casing is erected upon the ocean grounds, the USS articulates with an ocean side Entrainment Let out Steel Tubing (ELST) (that will be embedded in cement when the conductor casing is cemented) that is also capped. The ELST conjoins later upon ocean floor, with straight or curved 'conjoining tubing' 37 (as in the previous model) which in turn joins with IJT 5. The conductor casing 281 has FPS with SSD covered NRST about the well bore side, which unlike other casings, is bolted on either side by the crew in the rig or about ocean floor, the SSD cut to expose NRST when intermediate casing is hung. In the FIG. 1B, a fully deployed WGDT is shown with Cut SSD (CSD), whereas the 'inset' shows an intact SSD.

If the well casing are not thick enough, individual bolting of the FPS on either side of the casing through the burr holes may not be secure despite their rubber under lay. In this setting, when bolting is done, the nuts of the bolts are needed about the opposite side. The outlining of the two FPSs is marked on either side of the CWO to eliminate imprecision, and they have 8 holes also in the same position, and the bolts pass through both sides of the burr holes, no matter which side of the casing the FPS is bolted on. Inferentially, each flush plate comprises 4 bolt-heads and 4 bolt-nuts. This plan is especially important with regard to the GDT flush plate of the production casing that is directly exposed to the entrained gases, so as it would not be blown away. And even with thick casing walls, the GDT flush plate of the production casing is always deployed with a lengthy bolt with a long terminal needed to be left out after its nut is threaded in on the other side. It must not be overlooked thinking that it is going to be cemented, as when dealing with a giant gas entrainment, nothing but the best precautionary measure must be in place. The silicone underlay of the flush plates on either side of the production casing is made tougher with higher degree of vulcanization. Help with robotic arms is also needed, for the more work about the well bore side.

A standardized positioning of the CWO of the casings allows creating a slanted and properly aligned WGDT tubing, whereas a flexible and longer than needed length of the IWC ductal tubing are forgiving even when an otherwise non-negotiable mal-alignment is encountered. Even after conjoining the IWC of one side, due to compressibility of IWC ductal tubing, some movement of the casing is still possible for IWC conjoining about the opposite side of the well casing. Additionally, a plan to widen the AS by definitive terms is easier than be thought as plausible, as follows.

Flaring the top strings-manufacturing top strings even by imperceptible flaring, starting 5 inches off the joint from bottom to top (except for production casing), can widen the AS at least by 1 inch, making an otherwise restrictive IWC deployment less cumbersome (a bright lighting being essential to light up the AS). The other lower strings can yet remain the same in their structuring.

Confirming WGDT Sealing—before casement cementing, proper sealing of IWC conjoining within AS needs to be confirmed. A layered gauze pad slightly wider than the radial length of IWC, is tightly wrapped around the IWC, and colored water is injected through the outer NRST of the IWC that has a small nozzle at its base which after the SSD is cut, is connected to a non-collapsible rubber tubing that progressively widens. The devising greatly facilitates the colored water easily flowing into the lower incline of the IWC. After few minutes, the removed pad is inspected for staining. No staining confirms that the tubing is properly sealed assuring that the cement slurry will not leak in, and block the IWC of the WGDT, as the whole patency of the IWC at all levels is aimed. Both ends of the gauze have long Dyneema twines affixed, and at least one is always held on during testing.

The gas and oil sensors are incorporated at different levels of well bore side of a production casing 284 during manufacturing and the casing 284 handled with caution throughout, until its deployment. As an alternative thereof, they are incorporated into accessible interiors of the bottom, top, and midway strings of the casings 284 at the rig level, before it is deployed. If wiring is needed for signal transmission, they can emerge through the well head, to pass to the rig through the riser.

A second set of GDT—manufacturing top strings with another set of WGDT at a lower level is an option, wherein ocean side ELST of the conductor casing ascends vertically adjoining the casing, and then run in parallel with the upper ELST, to reach the ocean floor, to articulate with the conjoining metal tubing 37 that takes a deviant course from the other tubing.

Addressing possible concerns—(1) the two CWO about the top strings, for an easy traverse of the WGDT, can be a startling acknowledgment to the oil companies and the crew, and as those who strive for an inverted 'fort like' well structuring, they seem as the greatest vulnerable areas contrary to everything they believe in. It is true they are vulnerable areas, and be it so, as they were built to be vulnerable areas. The vulnerability of an off shore oil well is with regard to a gas entrainment, and before and after the anticipated time of its occurrence, there is usually no major concern to worry about. When the WGDT is built to open the casements about the time of gas entrainment, or else the entrainment itself can rip them apart, where is the need to worry about the clean cut openings built as the protective passage ways? Any fear or concern is totally unfounded.

Most of said passage ways are dismantled and the rest cement sealed, after the passing of the eventful timing; (2) the SSD about the well bore side of the casings wherein drilling fluid circulates, can be felt as a worrisome constriction impairing efficacy of drilling. As per Pascal's law, the pressure generated at rig level to be transmitted to the deepest site of the well bore through a closed fluid system, will not be affected by constrictions or otherwise enlargements of the fluid passage ways, as long as the closed circuiting system is not breached. The imperceptible disc like rise of the SSD imparts great protection.

The Sea Level Gas Separator of the Oil Well Effluent

FIG. 4, illustrates a prototype model of a 'Sea Level Gas Separator of the Oil Well Effluent' (SLGOE) Unit 34, which is simple in its operation though devised for functions never pursued before by the industry. The unit accomplishes oil-gas separation in a 'fire-safe' manner following an event, and the same is expected even when the unit is elected for oil-gas separation on a regular basis.

The SLGOE unit 34 about the rig site can be functional before and after the deployment of the production tubing. It is schemed that the effluent reaching the rig level routinely by-passes the rig to enter the in-vicinity SLGOE unit 34, and after the gaseous elements are separated by the SLGOE unit, the oil reaches the rig/oil receptacles, whereas the gas enters the gas receptacles. As the diversion of the effluent into the SLGOE unit is always a planned event after a well blow out (it can be recalled that a clamp should be unclamped for the effluent diversion into a SLGOE unit), the tanks of the unit are emergently filled with oxygen-free atmospheric air at this time, precluding explosive fire within the unit, as the freshly emerged oil-gas can be at 300° C. temperature.

The Prototype SLGOE Unit and its Flow Principles

The following describes the SLGOE unit 34 located about the surface waters of the rig's vicinity.

The Gas Separator Tank—the illustrating FIG. 4 shows the effluent collection tubing to be reaching a moderately large metal 'gas separator tank' 404 of the SLGOE unit 34, entering through its top as its inlet tubing 24. The inlet tubing 24 can be more than one in large wells if so elected. The bottom of the tank 404 has sieve-like perforations 76, whereas the top of the tank 404 is fitted with widely configured gas outlet tubes 78. The tank 404 also contains a smaller lower compartment 82 below the sieved bottom, said compartment fitted with a large bottom outlet tube 84, its diametric configuration devised to be wider than the well's incorporated production tubing. The bottom perforations 76 of the tank 404 are in strategically configured concentric circles designed to filter the effluent to prevent occasional blocks to the bottom outlet tube 84 by large globs of effluent. The gas separator tank comprises a dispersion device (FIG. 5) 583, to disrupt the semisolid effluent about the bottom, the device 583 detailed subsequently. The oil effluent entering the gas separator tank 404 at its top through the inlet tubing 24, down flows into the spacious milieu of the tank. Such down flow of the effluent instantly separates the gaseous components that will reach to the top of the tank, to enter the gas outlet tubes 78 clustered all through the top. The gas outlet tubes 78 converge into a large common gas pipe 40 that emerges through the SLGOE unit's modular enclosure 32 to reach the gas collection system and/or the surface gas receptacles. The mostly gas-free liquid and semi solid crude flow down through the sieve-like perforations 76 into the bottom compartment 82 of the tank 404, wherefrom the outlet tube 84 lets the effluent out continuously into an 'oil passage' tank 424 located at a lower level wherein the oil flows down from the top. The gas separator tank 404 comprises a video device 568 positioned adjacent to an air tight glass window, to record the state of affairs within the tank.

The oil passage tank—the oil passage tank 424 is also fitted with widely configured cluster of gas outlet tubes 74 in the top (to also join the common gas pipe 40 and the gas collection system), whereby any remaining gaseous elements are further separated from the oil passage tank 424. Through a tube 428 emerging from the oil passage tank 424, oil reaches the oil receptacles (or a land diversion system) via an outlet tubing 26, by mechanical means of 'siphoning'. The tube 428 originates from the bottom liquid column of the oil passage tank 424 to ascend to a higher level. The incorporated model of oil passage tank 424 completely alienates the drawing force (as an effect of siphoning), whereby the gaseous components will not be otherwise drawn into the downstream oil collection system. Such drawing force by means of siphoning is exclusively directed to the lower level effluent column within the oil passage tank 424, a safe guard when a pressured gas admixed effluent enters the SLGOE unit 34. The inlet and outlet tubing of the SLGOE unit 34 enter/exit the modular unit 32 above the surface water (FIGS. 4, 6 and 7).

The devised model has four great advantages for an instant oil-gas separation, as below—

(a) the devised down flow from the top of the tank facilitates an instant separation of the gaseous elements about the top of the tanks.

(b) as the commonly encountered gas like methane having a low molecular weight (which is 16 vs 32 for oxygen, 44 for carbon dioxide, and 28 for nitrogen—to make a comparison), it readily enters the gas collection system located about the top, with great ease.

(c) as most of the gaseous elements originate in the top of the tanks to start with, only some separated lower down, it is the greatest advantage in the devised model with regard to the concerned gases of very low molecular weight that readily enter the gas collection system located about the top, with great ease.

(d) even with regard to a liquid gusher, its force is attenuated by an instant separation of the gases, whatever be their proportion, as yet deemed to be contributing to the force.

The safe configuration of the devised model—the (pressured) gaseous elements enter the SLGOE unit through a moderate caliber of its inlet tubing 24, whereas they spread out into the tanks 404 and 424 as also into the fully clustered gas outlet tubing 78 and 74 about the top of the tanks, whereby the pressure is greatly attenuated (the volume and pressure within a gas containment being inversely proportional). The illustration of single common gas pipe 40 is only a schematic and it can be larger than depicted as also multiple in number.

The SLGOE Unit Furthermore Having the Following Fire-Safe Devising to be Receptive to Pressured Oil-Gas Effluent without Causing an Explosive Fire—

1) A sideward outlet tube—the common gas pipe 40 of the SLGOE's modular unit 32 is provided with a large 'sideward outlet tube' 57 with one way valve 406 that opens to a set forth pressure threshold, said outlet tubing terminating into an underwater gas receptacle of the ocean grounds, wherein the temperature is 4° C. at 200 meters and deeper; and multiple outlet tubing 57 of the common gas pipe 40 are not precluded.

The underwater gas receptacles—the outlet tubing 57 enters a sea floor gas receptacle as its inlet tubing and the inlet tubing enters into a bottom column of a water tank of the receptacle, the tank devised to discern the inflow of the gases, viewed through a glass window of the receptacle, the top outlet gas tubing of the receptacle joining the land gas collection system.

2) A clamp 43—the common gas pipe 40 of the modular unit 32 has a clamp 43 immediately distal to the sideward outlet tube 57.

3) A pilot side tube—the oil passage tank 424 is provided with a L shaped pilot side tube 66 about its bottom; a horizontal limb of the L tube emerging from the modular unit 32 continues as its perpendicular vertical limb with a closed top; the vertical limb through a lengthwise break-proof glass window, is devised to show the column features of the fluid effluent within the tank 424.

4) A bi-pronged tube—a normally clamped stem (not shown in the figure) of a bi-pronged tube, is set forth outside the modular unit 32, each prong 58 of the stem entering either tank of the SLGOE unit as short inlet tubes positioned nearer to the top, higher above the midway of the tanks.

5) A sturdy clamp—the oil outlet tubing 26 emerging from the modular enclosure 32 of the SLGOE unit 34 has a sturdy clamp devised to be electively clamped or unclamped.

The Diversion of the Oil-Gas Effluent to the SLGOE Unit—

Following closure of the one way valves of the GDTs (that is, the WGDT and the RGDT) to the effluent out flows, the EDTs (that is, the EDTW and the EDTR) are unclamped to divert the effluent to the SLGOE unit 34 if such measure is elected by the oil company. When it is elected, the sequence of the requisite operations are as set forth below—

(a) The fluid column within the tank 424 as being non-existent, is noted in the pilot side tube 66, and oxygen-free atmospheric air is pumped continuously through the pronged tubes 58 by opening the clamped stem of the bi-pronged tube, while the large common gas pipe 40 of the modular unit as also the gas collection system distal to the surface gas receptacles are kept un-clamped (as a warning to workers handling oxygen-free atmospheric air-Nitrogen predominant atmospheric air with no oxygen if inhaled in a large amount can be lethal, as it dilutes the blood's oxygen content without any prior warning symptoms); the process allows the SLGOE unit as also the gas receptacles to be filled with oxygen-free atmospheric air; as a measured volume of the oxygen-free atmospheric air that is equal to the volume of the tanks plus the gas receptacles along with the intervening tubing is pumped, the stem of the bi-pronged tube is closed.

(b) After the tanks of the SLGOE unit 34 and the surface gas receptacles are filled with oxygen-free atmospheric air, the gas collection system distal to the surface gas receptacles is clamped, to save the oxygen-free atmospheric air in the SLGOE unit 34 and the gas receptacles, so that the pressured gaseous elements if any, enter a safe oxygen-free milieu of the tanks.

(c) The oil outlet tubing 26 of the SLGOE unit 34 is clamped during the time the oxygen-free atmospheric air is pumped into the SLGOE unit 34.

(d) Subsequent to the foregoing preparation, the EDTs are unclamped and in 1-2 minutes the tubing beyond the surface gas receptacles are also unclamped; in the event pressured gaseous elements like Methane enter the SLGOE unit 34, being lighter with low molecular weight, they are deemed to rise to the gas outlets 78 and 74 of the tanks where from pressured gaseous elements are let out into the underwater gas receptacles through an one way valve 406 of the sideward outlet tube 57 that opens to a devised higher pressure threshold considered as 'moderately high', being set at a level higher than the company's chosen 'optimal pressure' threshold of the gases that are regularly collected into surface gas receptacles for ground transport. Normally the gaseous pressures range between 'optimal' and 'moderately high', whereas in the setting of a gas entrainment, the term 'very high' is added to the referenced pressure ranges. As the company decides the 'optimal pressure' of gas collection for ground transport, it acts as the threshold above which the one way valve 406 of the sideward outlet tube 57 is subject to open.

(e) When/if the divers note no gas bubbles emerging into the water column of the under water gas receptacles (indicating that the pressure of the effluent is optimized), as also the pilot side tube 66 shows fluid column indicating an oil flow, the oil outlet tubing 26 of the SLGOE unit 34 is unclamped to commence oil collection.

(f) Even after the oil flow is safely established, the sideward outlet tube 57 of the gas pipe 40 facilitates the 'moderately high' pressured gaseous elements above the set forth 'optimal pressure' threshold, to be let out into the sea floor gas receptacles on a regular basis, and only the gas flow of optimal pressure entering the surface gas receptacles. The practice is deemed safe, the subsea temperature being 4° C. at 200 meters and deeper as was noted, as also these gas receptacles being large compared to the volume of gases entering, whereby the pressure of the gases will be lowered before they enter the ground pipeline. It was also earlier noted that the pressure in a gas containment is directly proportional to the temperature (the Gay Lussac's law). After a continuous oil collection is established, the interior of the SLGOE unit 34 is devoid of oxygen, being filled with admixed methane of the effluent, and during an elective interruption to oil collection, it is a safe practice that the tubing beyond the tanks of the SLGOE unit 34 are clamped. In the same token, weaning rig site 'flaring' can be confidently aimed by oil companies. Every risk prone situation should be scrutinized in terms of the requirements of the 'fire triangle', the other parameters being mostly immaterial though seemingly suspicious and concerning.

(g) If there is a highly pressured oil gusher, its let out into oceanic waters is discussed below.

Oceanic oil let out and collection—additionally, there can be a provision for the oil outlet tubing 26 of the SLGOE unit to have a pressure let out one way valves to let out oil under tremendous pressure temporarily into the ocean waters so that an oil gusher will not flood the rig or the oil receptacles. It would be a wise option that it comprises an alarm provision so that the crew makes a note and collect the oil in massive floating oil receptacle(s) that is/are always kept at hand.

Economic merits—the oil company can safely collect the highly utilitarian fuel gas, almost completely through the SLGOE unit, as a cautiously configured extraction about the rig site. The aim is not to pursue 100% refining measures of oil-gas separation that is otherwise mandated for the Oil Refineries engaged in exclusive crude oil separation by highly involved Fractional Distillation.

The choice of a SLGOE unit—the SLGOE unit functions as an efficient oil-gas separator, following a gas entrainment and an oil gusher, until the production tubing is installed. The oil company may opt to have it incorporated into the well-rig system even for a routine oil-gas separation, and oil collection, as a better way to slowly wean flaring at the rig site.

The Facilitating Additional Measures Incorporated about the Well/Rig Site to Weather Out a Calamity To counter the event of a gas entrainment, a scheme of protective measures have to be in place in the confines of a rig, even before the well digging is initiated, as in the following-.

The rig site gas chasers—about the conduction platform, clustered around the marine riser there are high powered fans, activated by the well site gas alarms, to drive away the approaching gases sideward, so as they will not breeze into the rig nor rise up towards the derrick. About the bottom framework of the derrick fans are appended and are configured like ceiling fans, however with a 45° tilt, wherein the wind blown by the fans are in the same direction as winds from other fans. The guiding principle in utilizing the breezes of the fans to blow out the inflammable gases is—the direction of the breezes from all the fans must be synchronized towards one direction, and in any rig, it has to be chosen as per the dominantly prevailing direction of the wind in that part of the world (the prevailing wind). About the conduction platform that direction is kept open when ever feasible.

Cylinders of Compressed Oxygen-free Atmospheric Air (OAA) or Compressed $CO_2$ ($CCO_2$)—as the well signaled alarms point to a major catastrophe, the vigilance squad (VS) wearing open circuit SCBA (Self Contained Breathing Apparatus) mask instantly opens the enormous cylinders of Compressed Oxygen-free Atmospheric Air (OAA) or compressed $CO_2$ ($CCO_2$) kept in reserve (about the time of down hole completion), for the OAA/$CO_2$ to admix with the approaching inflammable gases, to avert an explosive fire. Compressed OAA/$CCO_2$ cylinders should also be appended to the frame work of the derrick at the lowest level (that is, lower than the installed area of the fans), and the OAA/$CO_2$ released upon a gas alarm. Both OAA and $CO_2$ being heavier than the inflammable gases, they encounter the gases as soon as they approach the rig level. The VS, specially consigned about the time of down hole completion, are vigilant round the clock for the signals from the well site gas sensors. Other crew members must leave the area even before the cylinders are opened, to get to the spray walks leading to the fire escape entry (the inventor's U.S. application Ser. No. 17/803,373) and they are allowed into the area only after the atmospheric oxygen/$CO_2$ levels are optimized. The COAA/$CO_2$ cylinders are closed as soon as feasible, and they are also vacated from the rig soon after the passing of the event. After the critical time had passed, regular oxygen containing atmospheric air is released into the rig confines to make the area safer in an emergent manner. The atmospheric air is stored in compressed atmospheric air (CAA) cylinders. The VS should also use specially designed large fire-extinguishers capable of pressured distant ejection, in case gas-fueled fire starts. It is an occasion to note that every risk prone situation must be scrutinized in terms of the requirements of the 'fire triangle', the other parameters being mostly immaterial though seemingly suspicious. However, the ignition sources are very variable and can be those least suspected, and it is the single factor that should be explored and eliminated. Most familiar sources are—sun, hot surface, sparks, damaged over heated electrical wiring, impact, cutting and welding flames, heating equipment, friction, electrical energy, internal combustion engines such as compressors, generators and pumps, kitchen equipment like ovens and microwaves. A check list must be made, and about the time of down hole completion the sources are eliminated.

The Canisters of soda lime in strategic places of a rig—even minimal fire can cause dense smoke with dangers of smoke inhalation which is also carbon dioxide ($CO_2$) and carbon monoxide (CO) inhalation, very early on. Huge canisters of soda lime (mixture of sodium hydroxide and slaked lime, slaked lime being calcium oxide or calcium hydroxide) boxed and sealed, can be placed in strategic places of a rig, as about the entry ways to the work areas and normally crowded places, to absorb $CO_2$ and CO, the latter being absorbed by the sodium hydroxide component of the soda lime at high temperatures. The canisters are specially devised so that a sealed canister (the $CO_2$ scrubber) is unsealed by remote control upon fire alarm, as also it may not be exposed to direct sprays of the sprinklers when unsealed. A contemporary CIP application by the Inventor 'Off Shore Fire Escape Devices including Sinking and Rising of a Detachable Island Rig' (U.S. Ser. No. 17/803,373) details large canisters of soda lime as $CO_2$ scrubbers.

The well site gas sensors and the GDT closures—these devising need a recall from an earlier detailing, as they are paramount in orchestrating immediate responsive measures in the rig. These are the simplest yet greatest additions that alert, prevent, and protect the crew from an explosive rig fire. Despite the well site and riser gas sensors, local gas sensing alarms in the rig site should not be over looked in case the other alarms fail, and the rig should be prepared for all unforeseen situations.

Sprinklers—sprinklers capable of pressured jetting should be installed where ever possible. Their installation within the base frame work of the derrick and about the conduction platform should be strived for, and the water is better derived from the colder source of the deep sea so as they can dampen any heated areas of the rig as also the heat of the incoming gases. The sprinklers are activated as soon as the well site signals ring an alarm. To be effective, the sprinklers are so positioned that the intended direction of their sprays are facilitated by the breezes of the fans.

Inferentially, the installation of all the above devices should not be in a random fashion, and it has to be carefully synchronized to best facilitate their intended functions.

It is a wise plan that a derrick man has an established scheme to land in a less hazardous distant destination within the rig, with no need to come down to the bottom of the derrick, an area to be emergently evacuated, except for the VS to stay.

The Plans and Measures that the Oil Companies, the Governments, the Concerned Agencies, and the World'S Citizens should Consider 1. Apart from planting and saving trees, soda lime is the single most utilitarian provision that the present day world can rely on, to reduce carbon foot print. It is great solace for fossil oil's obligated short term and possibly long term use in the future. Soda lime is made available as $CO_2$ scrubbers for its prolonged use, as noted above, and the $CO_2$ recaptured from it can be used to manufacture urea (ammonia+$CO_2$=urea), the world's ubiquitous plant fertilizer, whereby $CO_2$ disposal storage in geological reservoirs may not be necessary. Presently, $CO_2$ needed for urea synthesis is generated by large scale fossil oil burning by the manufacturers. Blue urea discharges least amount of $CO_2$ when used as a fertilizer, however, whatever amount is discharged, can be readily utilized by the plants/trees for photosynthesis. The farmers need detailed incentivizing education about the ways of using the fertilizers, that is—(1) the sacs of fertilizers with no wide openings have to be kept sealed and only opened just before they are scattered in the fields, and each sac should contain educational material in plastic pouch outside the sac, with a bold label 'Please Read'; (2) the fertilizers are to be scattered into the fields at sun rise and never at sun down, so that the discharged $CO_2$ from urea is immediately utilized by the green chlorophyll of the plants/trees in the presence of sunlight, for photosynthesis; similarly, it is to the advantage to water the crops early in the day, as photosynthesis also requires water.

Photosynthesis: $6CO_2+6H_2O=C_6H_{12}O_6$ (glucose)$+6O_2$

Glucose shown in the equation, by complex aggregation, is stored as starch or converted into cellulose that makes up the fiber or bark in the plants/trees). As also shown, a greater hidden advantage is, in the process of photosynthesis, for one molecule of glucose synthesized, 6 $CO_2$ molecules are taken in by the plants, to also give back 6 molecules of oxygen ($O_2$) into the atmospheric air (a doubled gift by the plant kingdom to the human race), whereas the $O_2$ used by the plants for their own respiration is only a fraction. Hence, it is an obviously easy proposition to reduce carbon foot print by encouraging people throughout the world to plant as many trees and plants as possible, where ever they can and whenever they can, evergreens that stay all through winter, and fruit trees with greater photosynthesis, being equally preferred as the big trees that grow tall and wide. Cooperation increases many fold if the science of $CO_2$ and $O_2$ is detailed, needless to say that knowledge is the power and propellant for action, as after all, it is the bubble people live in, that is filled with more of $O_2$ and less of $CO_2$.

2. Where ever $CO_2$ emitting fuels are sold, $CO_2$ scrubbers can also be sold, to be kept near places of carbon emissions, and the scrubbers are automated to open when ever the concerned machinery is in operation. This includes the back of a motor vehicle, wherein an universally similar model of scrubber in an air tight enclosure is deployed, and can be locked with the engine key and is automatically opened/closed as the engine is started/stopped. Old cars can have the equipment as appended enclosure in the back near the tail pipes, devised aesthetically appealing, and locked with a number lock. The car mechanics should be trained by car engineers to install them about all cars, the present car owners buying electric vehicles (EV) being a remote time agenda, and there being hybrid models as well. The scrubber lights up when it is used up, and the used up scrubber can be exchanged for a fresh re-filler at a gas station. The lit up scrubber shows the time since it is exhausted, and police may give ticket if it is past due by 1 week. As the natural resources needed for the batteries of the EVs are also limited and need mining, gasoline driven cars may go hand in hand for the economy of either. The government must make the $CO_2$ scrubbers free or of minimal charge, mandating it as federal supply to the gas stations, and the gas stations paid for their services. $CO_2$ scrubbers can also be studded about the limiting outer boundaries of the interstate and state high ways as also about busy inner city roads. This vigilance extends to domestic outdoor grills also. Citizens should have incentivizing education that the air is cleaned up for their own good, and that the heart, lung, and brain health as also the life span are thereby improved.

The soda lime in the rear of the cars should be protected from rain. To counter the problem, the gas entry inlet of the $CO_2$ scrubber enclosure should be opening towards the front side interior and away from rain pours coming in from the rare side exterior.

3. Hydrogen can be used as an alternative energy source, the Hydrogen easily generated by just adding water to beads or pellets of silica gel (as per the university of Baffallo), the availability of silica being ubiquitous. The renewable ecofriendly hydrogen sourced energy is remarkably dense, however, the translation of theory to practical automobile powering is shrouded in uncertainty.

4. EVs are being manufactured in leaps and bounds, but the optimism should be coupled with full knowledge about the future prospects. People think they are saving the planet by using EVs, but the source providing electric power to the charging station, most likely is the fossil fuel. Only 11% of US energy comes from renewables, whereas other 89% is from petroleum, natural gas, nuclear electric power and coal. The fossil fuel combustion at the power plants produce 73% of global emissions of $SO_2$ and 20% of global emissions of $CO_2$. However, carbon capture in this setting is easier, as it is a controllable localized emission. It will take time for total renewable resources, yet their electric power is not dense. Until that gets better, economy of use for any vehicle should be the goal. Using nickel for coins must be stopped and people can exchange them for newly minted aluminum coins. It is predicted, that our planet runs out of fossil fuels before the end of the century and what is thus far used are stores from millions of years and obviously cannot be replenished. And what if the renewable energy is not as dense to be an equal substitute to fossil fuel in meeting global energy needs? That is why economy in any case is direly warranted, and a foundation to suitable alternatives to subdue oil/energy demands for the next decades should be planned now, as it will not happen overnight when a crisis emerges. How is it possibly done?

5. Common public commutes like trains and buses (a double decker, as in UK) should be encouraged in exceeding manner in all places, not just in cities. Government must also encourage building work places with top living quarters to the workers. Existing work areas can add them with pillars raised all around, and the top living areas built like houses built on pillars with bottom crawl spaces. Large parking lots of commercial buildings (like Walmart's) can build living quarters at higher levels. Government should aid companies not wealthy, for such constructions, so that the owner can get the rent and pay back a preset amount every month without interest. 'Rent to own' should also be encouraged. There can be efficiency as also 1-4 bed room quarters to choose from. Staying in the work area should add some score in job selection to incentivize the applicants. There is no reason why anybody should drive to work for an hour or half, which implies more sky scrappers with no unwarranted automobile emissions around, are the key. Said govt. built/funded sky scrapers (that sway to high winds but built safe) further more having self-managing grocery stores with high demand foods, hair salons, baby-sitting areas etc. are practical and helpful. Future apartment buildings and sky scrapers are better built with wall length planting corridors within the walking corridors filled with ever greens and shady plants, to be strictly maintained by the tenants or the management. As there are always housing constructions taking place in cities and towns, volunteer workers can be trained well to participate in the constructions, the best of them honored, and the event be made a local newspaper release and TV news release. Very capable teenagers and young adults are becoming TV, sports, and internet addicts whiling away time in useless pursuits, and they have to be motivated to participate in constructive agendas. Public commutes and work site housing should be advertised and popularized. If celebrities make surprise public commutes on a regular basis, people will stay interested. As the world is programmed to work from home since COVID-19 pandemic, it can be encouraged to continue, at least in view of rising gas prices and inflation, though few are suitable for such option.

6. Future roads should be broader with a separate safe path for adult bicycles and tricycles, such tricycles having large carriages in the back and in the front so that local commute like visiting nearby friends, going to churches, restaurants, and grocery stores can be carried out without expending fossil fuels or electric power, children being also seated in the carriages. The front seat, for two to be seated, can be lengthened, and the tricycles made as narrow as possible to be less space occupying. As also, they should have a front and back fixtures for large umbrellas to protect from rain, whereas the carriages have sturdy plastic closures. Simple tricycle models are available on the internet for $200-400 for exercising groups, while some electric models are pricier. A couple or teen agers can go together in two tricycles at no cost and for good amount of exercise, the latter minimizing wide spread adult and childhood obesity. City/town curb sides can be suitably promoted with more ramps and such other provisions. People can go to nearby work places also in tricycles with car parking areas used for their stalling. One lane can be sacrificed in high ways and interstate road ways by erecting a small separation boundary within a tricycle lane which can be made smaller. It means there is no direct mingling of cars and tricycles in a same lane, as it can be dangerous. Entries for ramps with controlling traffic lights allow tricycles and cars separately to enter designated lanes. Admittedly, 'easier said than done' is applicable to the devised plan unless a genius engineering with eye on safety can materialize it. Fortunately, there are genius engineers who built wonderful road ways here and around the world. Obviously, the plan is better executed in newly developing areas, wherein complete separation of transits with small erected walls can be planned beforehand. Very small, wholly covered, 1-3 boarder tricycles can also be made, with sliding doors and foot pedals, and also electrically home-powered overnight.

7. In suburban areas and in large apartment complexes, people can go for grocery shopping every week by planned car pooling, and grocery stores can have different colors of shopping bags to prevent mix up. Some stores home-deliver the groceries, which can be widely encouraged.

8. At least in the south, the AC can be completely shut off during October and the homes are let to cool off in the 50-60° night temperature, as people sleeping under comforters do not feel the weather as too cold, while it takes time for the homes to catch up with the higher temperature of the day. Later when it gets cold, 2-3 small heaters can be used until warming by AC is absolutely needed. It is especially applicable when a single person or a couple lives in a 3-4 bedroom home where some of the rooms are not used. It is a better option to put the thermostat to the highest tolerable temperature during summer and lowest tolerable temperature during winter (the same applicable to diurnal temperatures), as also using electric heaters in the rooms most used can help the AC to be set at lower temperature than tolerated, which lowers the work of the AC. Summer time is challenging as no cooler can rise up to the performance of the AC cooling.

Every plan in the fore going is a collective responsibility to be shouldered by all the citizens of the world. Wide spread advertising by celebrities people love and trust, is a key for success. These measures will lower the prevailing oil-gas-energy expending that may not be otherwise lowered.

9. Lithium's under ground deposits should be explored intensively in US and in the rest of the world, and their underground detection by trained dogs could be one option.

10. Luckily, rigs do not otherwise release excessive $CO_2$ if flaring is stopped. This disclosure enumerates a best mode contemplated, how the admixed gases of the crude oil can be separated mostly at the rig level, so that flaring can be slowly weaned by the oil companies for the common goal of zero carbon emissions, and to be responsible future survivors in their business ventures. It also helps against negative outlook of future, to embrace countering measures with positive attitude.

11. Off shore natural oil seepage—in fact, a surprisingly less known fact is, off shore oil and gas production benefit economy and environment (Bruce Allen, The Heritage Foundation, *Environment*, Nov. 30, 2009), especially in areas of active oil seeps like Santa Barbara of California, where seepage exceeds 240,000 barrels every 4 years. Papers by British Petroleum in early 1900s show that 75% of world's oil bases contain surface oil seeps and according to National Academy of Sciences, 63% of hydrocarbon pollution in US waters stems from natural seeps and only 1% is from off shore drilling and extraction. Research indicates if off shore production were expanded in the seep zones, methane and ozone forming reactive organic compounds would be further reduced by lowering the pressure of the under ground reservoirs. The world should rethink about oil ban and drilling should be encouraged and carbon emissions should be tackled by one great provision easily doable—PLANTING TREES, and any money spent on that is money well spent.

12. Wild fires and forest grids-wild fires are the worst disasters in every respect and the carbon emissions into nature are immeasurable. The following is suggested as proactive measure to control and confine the wild fires, especially in areas more prone.

Forest 'gridding'—though stopping wild fires altogether is difficult, their spread into adjacent human habitats should be controlled. Urban tree cutting should be stopped and the timber needed for human use should be solely from the forests. The trees of the forests adjacent to human habitats should be cut to derive wood, and such cutting should be in the form of a grid and the cleared areas should be wide enough that the fire will not spread through the gaps created. This is in contrast to the practice of cutting the trees at the periphery, progressively inching to deeper areas of the forest. Gridding is the best way to stop wild fire spreading into adjacent dwellings causing property loss, human suffering, and displacement apart from extreme carbon emissions. There is added advantage, that is, more trees get direct sun exposure (whereas normally, only the tops of the trees are actively involved in full blown photosynthesis). It is only a shift towards cutting forest trees for needed timber rather than cutting them in cities and towns where the trees are most needed. Gridding also improves the air movement so that more $O_2$ will be blown towards human habitats and $CO_2$ will be drawn into the forests, where it is most needed.

This disclosure comes across as means of encouraging the use of fossil fuels. No denying that, as there is no choice for the next few decades, and it tells how it can be best pursued as long as it needs to be pursued. In the same token the Inventor feels it as the deemed responsibility to suggest other positive measures as soon as such notions are conceived, to halt the climate change, as also to face the near or remote future without fossil fuels, and possibly with no equal substitutes.

The Modular Protective Enclosure of the SLGOE Unit

In view of the utmost functional importance of the SLGOE unit 34, it is deemed prudent that the whole unit is designed to be secured in an enclosed protective structure, herein actuated by structuring the unit in a shell of modular capsule 32, the latter provided in pre-configured sizes. With all the inlets and outlets capped, the modular 32 is deployed in its destined reception site atop a metal board 36 (FIGS. 4, 6 and 7) about the vicinity of the rig. As the needed stepwise incline of the tanks 404 and 424 are configured within the modular capsule 32, the base of the modular itself can conform to a horizontal plane, for its easy and secure stationing upon its base structure 36. The compatibility of the unit is configured by the number and size of the tubing to be incorporated, while such objectives may be conventionally standardized.

The modular 32 is structured with shopping-cart like wheels to its bottom, for its precise stationing. As earlier described, a video monitoring device is incorporated into the modular 32 also, in addition to its incorporation about the gas separator tank 404. The modular unit 32 is equipped with conventional 'hooked' and 'ringed' structures, strategically placed about its outer shell, and detachable fixtures to the bottom cementing needed of its secure stationing upon its base structure. Such detachable yet steady stationing allows a replacement of the unit, when needed. The modular resists perturbations of the oceanic weathers, by virtue of its barge like base structuring resisting any upheavals, to stay in an upright positioning. Due also to resilience of its disposition by the anchoring units of linearly set metal strings comprising of metal rods 38, breaking from or colliding with a leg of the rig, is precluded. Additionally, the carrying, appending, and anchoring structures of the modular being air-capsuled, the overall strain of the imposed weight upon a leg, even during oceanic upheavals, is minimized. A future cumulative experience will shed light upon the merits of the foregoing dispositions of the modular, if they are nearly comparable to its disposition upon a single leg, the latter being undoubtedly secure. Other details are specified in the section detailing the SLGOE unit. The tanks of the unit can be set forth fairly close to each other, so that the modular unit 32 as a whole would be less space occupying. Threading in entirety of the unit's tubing system, is as described in the concluding section of this disclosure.

The Disposition of a Prototype SLOGE Modular in the Rig Vicinity

The SLGOE unit's modular capsule 32 (FIGS. 4, 6 and 7) can be erected on a single leg, or anchored to the rig by units of metal strings below the surface water 528. In the latter plan, the metal strings are anchored to the leg 54 of the rig in a hemi-hammock like arrangement. Each unit of metal strings has 2 strings, wherein each string is made of sturdy but narrow metal rods or poles 38 (about 2-3 cm in diameter) (FIG. 6). In each unit as shown in FIG. 6, the adjoining metal rods 38 of a string are connected by a 'linkage ring', whereas said linkage ring and the ends of the two linked rods 38 are connected to the center of a rod 38 in the paired string of the unit running parallel, thereby precluding any redundancy to both strings of an unit. The strings are shown in the drawing with exaggerated dimensions to clarify the structure. The arrangement prevents the strings from sideward bending or sinking, so as to maintain their desired axial length, whereby the modular is precluded from getting closer to the rig. The units of coupled strings are multiple and fan out to the site of the modular 32, and through closely set eyelets a coupled unit of strings connect with adjacently lying coupled units via metal ropes to make a grid, with the metal barge 36 and the atop modular capsule 32 resting on the grid. The rods 38 can be many feet long, wherein the originating rods of a string are connected by bolting hard ware with no linkage connection to the leg 54 which makes the strings not to bend or sink. Underneath, the strings are supported by polyvinyl chloride (PVC) blocks 42, the latter with locked-in air columns 48 about the tops. The PVC blocks are situated about the center of the fanning hammock. Each squared block 42 is 4-5 feet in lengthwise-widthwise dimension, wherein the adjacent blocks connect by linkage rings. The row of PVC blocks 42 continue to also lay underneath the metal barge 36. The central row of the PVC blocks 42 are furthermore connected to smaller metal strings 46, the latter similar in their structure to the strings about the top, comprising of metal rods 38. The strings 46 originate from the leg 54, and they tangentially radiate upwards to connect to the PVC blocks 42, however, with no bending, whereby they keep the PVC blocks 42 stable under water, curtailing their tendency to float to the surface. The originating PVC block 42 is connected to the leg 54 directly by bolting hardware with no ringed linkages. The entire structuring makes the strings 46 and the PVC blocks 42 resilient and not break due to oceanic perturbations, thereby also precluding the SLGOE modular 32 from colliding with the legs. The air-locking blocks 42 under water are not exposed to extreme heat in the event of a rig fire.

The FIGS. 4, 6 and 7 show a video device 568 adjoining a top window of the tank 404 and a solar battery power source 526 within the modular, located adjacent to a break-proof glass window. The modular 32 has desired accessing and protective amenities like—an air tight door (set forth above water); a corridor 402; multiple enveloping burlap covers 408; surface fans 420 (about the rig side) activated by gas/fire alarm; and sprinklers 458 (studded about a sparse frame-work of exoskeleton 432) (FIGS. 6 and 7); a pathway 434 (with ½ foot of water submersion) set forth upon units of metal rods 38 makes a pavement to the rig. Powerful jets of water 438 also emanate from the exterior of the modular corridors about the level of the surface waters, to keep away the spreading fire on the oil-laden ocean waters, upon a rig fire.

The SLGOE unit 34 can also be installed upon a single leg structuring, which can be a better option though economically and structurally imposing. The legs 54 of the rig rising above water are enveloped in many layers of burlaps, and studded with sprinklers that are especially forceful about the level of the surface waters 528 (where oil can stagnate), the legs being the back bones of the structures they support, and need to be protected from collapsing, in the event the fire lingers upon oil-laden water. A sprinkler tube of high caliber jet also accompanies any tubing not under water in the rig vicinity, said tubing also burlap-covered. The exemplified fan 420 in FIGS. 6 and 7 can be very large, each blade spanning not less than 5 feet, few inches intervening between the blades of the adjacent fans. The rig's fire/gas alarms are connected to the modular, to activate the fans and sprinklers about the same time, and the gas and fire will not spread to the modular confines with already activated fans and sprinklers.

The corridor space 402 can also serve as an instant destination for fire fighters jumping into the water (while a water sealed basement of a Detachable Island Rig, as in a contemporary application/patent, serving as a highly safe-guarded fire escape within the rig, for the rest of the crew), or can also be a vigilance/security station, if erected on a single leg. The surface gas receptacles can be set forth near the SLGOE unit when a single leg is chosen, as the gaseous elements collected are designed to be safely attenuated.

The Disposition of a Prototype SLOGE Modular with an Anchor Base

In a simpler modification of the foregoing, as shown in conformity thereof in the schematic of FIG. 7, not drawn to scale, submerged 'anchors' 580 from a rig's reinforced leg structure 582, can serve as supporting structures of the modular 32. The anchors' metal frames locking air columns 543 can obviate strain upon the leg 54. The reinforced leg structure 582 can be bolted after the legs are erected in the usual manner. The anchor columns 584 rise in an incline to reach the modular site, and are stabilized by sturdy hoisting ropes 581 of metal that course perpendicularly from the leg 54. The hoisting ropes about the lower levels are substituted by strings of overlapping metal rods 38 as in the foregoing model, similarly spanning from the leg to the anchor columns 584. A submerged air locking PVC block 579 incorporated into the anchors' terminal and comprising an atop metal barge, is designed to conforming a modular base. A submerged pathway 434 from the rig, set forth upon PVC blocks 42 with locked in air columns 48 (held in place by centrally placed hoisting ropes 581 underneath), lays below the surface water 528. The rest of the structures as in the foregoing model directed to the modular, are retained in this model, and not herein repeated, however, most of said similar structures are shown in the FIG. 7. The two anchor columns 584 terminate on either side of the PVC block 579 for a better stabilization of the modular. This simpler model can be a choice when a modular is planned to be set forth not too far from a rig.

THE VIDEO MONITORING OF THE SLGOE UNIT—in the SLGOE unit 34, the gas separator tank 404 is provided with a video device 568 (FIGS. 4, 6 and 7) to monitor the state of affairs within the tank. The video device is designed to be operable by a solar-powered battery source 526 located inside the modular 32, adjacent to a small break proof glass window. The tank 404 near its top (about a side opposite the oil inlet tube 24) is structured to have a window fitted with an air tight break-proof glass closure with vulcanized rubber edging. The window closure opens only to the tank's interior, with the opening/closing mechanism similar to a conventional automated door, wherein an opened door when left ajar, closes automatically after few seconds. The window has a reliable air tight locking by the devised window closure. As problems can be reasonably expected lower down in the tank, the video device 568 is designed to be positioned with a downward incline about the lens side fore-structure, to facilitate a better picturing of the lower half of the tank. The figures show such positioning. The video when needs to document the tank's interior, a projectile structure of the 'video-rest', upon a remote signal, pushes on a control button, designed to open the window door. The video then passes in to picture the lower half of the tank in a full view. When stopped, the instrument retreats, as the window closure locks in few seconds. The devised mechanism facilitates clear picturing of the tank each time, without the camera lens smeared by the down flowing oil/gaseous elements of the tank. It needs an immediate follow through that an additional video, also installed in an optimal position within the modular, documents that the tank's window door is properly shut.

The 'Spiked-Circle' Dispersion Device

Optimally, the gas separator tank 404 of the SLGOE unit has an 'oil dispersion' unit, its enlarged depiction illustrated in FIG. 5, whereas its disposition within the gas separator tank 404 is depicted in FIG. 4. The dispersion device 583 comprises-(a) a 'spiked-circle' dispersing device, preferably in steel, the device structured in concentric circles, the circles being connected radially; (b) a central supporting vertical rod 589 of the dispersion device 583, the rod fitted to a top structure of the tank 404 (FIG. 4); and (c) a 'motion control' device (not shown in FIG. 4) of said central supporting rod 589, set forth outside the tank 404.

The device 583 moves up and down while 'put on' to be operational, as when a block to the down-streaming flow from the tank 404 is suspected. It can also be operational in continuum at pre-set intervals, that is, at about 3-5 minute intervals, in effect, conforming to 4-5 axial motions each time, each axial motion comprising a complete downward and upward movement.

The dispersion device 583 has a lamp shade like configuration with a minimal incline. The concentric circles 587 of the device 583 have downward extensions with knife like cutting edges about the bottom (not shown in the drawing), wherein said cutting edges also have spiked projections 590 in strategic places that correspond to the positional configurations of the bottom perforations 76 of the tank 404 (FIG. 4). In a downward thrust of the disperser 583, its spikes 590 disrupt the blocks to the bottom perforations 76 of the tank 404, whereas the bottom cutting edges of the concentric circles 587 severe large globs of oil settled about the bottom of the tank 404, thereby the dispersion device 583 serving dual purpose. The cross sectional structuring of the spikes 590 are devised to be similar but smaller than the perforations 76, as, in a downward motion of the device, all the spikes 590 are designed to pass through the perforations 76. In conformity thereof with the designed function, the bottom extensions of the concentric circles 587 located nearer to the center, are devised longer (in view of the lamp shade configuration), whereby the lower ends of the spikes 590 of all the concentric circles 587 are in a same horizontal plane, so that all the spikes 590 can pass through the perforations 76 of the tank 404 in the downward motion of the device 583.

In this model, the spaces 591 between the concentric circles 587 are wide, and there are only two radially positioned members 592 connecting the circles 587, whereby the semisolid crude of the effluent will not settle about the top of the dispersion device 583. It further facilitates an easy ascent of gases separated in the bottom of the tank. The bottom perforations 76 of the tank 404 are devised to be oblong, such structuring facilitating better passage of the semisolid effluent. With the unit as devised, a continuous oil flow down-stream is always ensured. The dispersion device is normally positioned in the bottom level of the tank 404 just above its oil column, so that the movement of the device 583 as well as the time needed of such movement to reach the sieved bottom of the tank 404, are brief. A control device for the up-and-down movement of the central supporting rod 589 of the device 583 is positioned outside about the top of the tank 404.

The Oil Separator of the Water Admixed Effluent

The effluent received by the SLGOE unit after an acute event being a water-oil admixture rather than oil-gas admixture is not an objectionable matter, as the crude oil collected is being ultimately diverted to an oil refinery for a fractional distillation. If the standard practices of the refinery reject the heavily water contaminated crude oil, for financial reasons or other, it is an alternative that the let out effluent from the SLGOE unit 34 be diverted into the tank of an 'Oil Separator of the Water Admixed Effluent' (OSWE) to separate a major portion of water.

The prototype of an OSWE—the Oil Separator Tank 571 (FIG. 8) isolates the oil from the water admixed effluent to a reasonable extent. Due to relative densities of the two liquid bodies concerned, the water 572 settles to the bottom of the OSWE tank 571, whereas the oil 573 rises to the top, as the admixed effluent 574 flows from the SLGOE's outflow tubing 26, entering the tank 571 as a sideward inlet tube 575 situated just above the midway of the tank. On the opposite side, nearer to the top of the tank, oil 573 leaves the tank through an oil outlet 576, whereas from the bottom of the tank, the settled water 572 flows through a water out let 579 back into the ocean 528. The inflow and outflow are controlled by flow clamps to maintain the fluid level within the tank 571 in such a manner that the inflow from the inlet side tube 575 is not a down flow, but a tempered sideward merging into the midway of the fluid column, so that there are no undue perturbations in the settled layers of different densities. As the incoming ocean water can be of large volume, a separation effectuated in this manner facilitates its return to the ocean with no significant contamination, and oil collected also with no excess water admixed. The water disposal in any other manner is impractical in the midst of the ocean, however, the outflowing water 572 into the ocean is periodically tested, to be controlled for its hydrocarbon content.

The OSWE can be used by land crew to separate water before delivering the crude to refineries.

Properly disposing of abandoned wells—there are many off-shore oil wells in US territorial waters that were left temporarily or permanently abandoned leaking petroleum oil in variable amounts into the ocean. This is an on-going pollution that is a threat to the ecosystem and the aquatic life forms, whether or not they happen to be our food sources.

A permanently abandoned well if leaking, it means the well was not completely evacuated, as fossil fuels are exhaustible and do not originate from the rock formation in an on-going manner. Accordingly, the oil companies should make it a point to empty the well completely, and then permanently cement sealing it. The oil companies are already injecting ocean water into the oil containment to bring out the last remnants of oil, but it is possible that they were/are not realizing that they did not get to the last remnants. Hence, in this setting, the oil admixed with injected water can be passed through the OSWE to completely recover the oil to the last drop as also to ascertain that the well is totally dry. The oil 573 if no more flows from the tank through the oil outlet 576, it indicates that the well is completely exhausted. The gas can also be collected through this tube initially as also intermittently lowering the fluid column lower than the oil outlet 576. Sufficient time is allowed before deciding that the last remnants are collected for the cessation of the process. The well filling with oil or gas later on by permeation from a previously separated adjacent reservoirs is a very rare event. There is no reason to postpone oil collection from temporarily abandoned wells, and they can also be dealt in a similar manner. Wells that were abandoned after a blow out and are leaking, can be taken care of by first sealing the breaches of the well bore in an easy manner as described in the upcoming section of this disclosure. Production tubing can be installed without the riser incorporated into the system, and oil collected by off shore or on shore receptacles. All these are only monetizing endeavors while additionally halting climate change and keeping our ocean waters safe and pristine.

Consequences Upon a Well Blow Out and Suggested Action Plans, a Restoration of the Well Bore, Well Head, and Vicinity The extent of breaches about the well head structures depends upon the severity of the well head blow out. In severe cases the riser can sustains damage with the blown out effluent escaping into the ocean waters. The consequential events and remedial measures are set forth as below—

(1) Well head blow out with no damage to the riser-despite well head 510 blow-out, most of the elements of the pressured gas entrainment still find their way through the WGDT, the let out continued until the subdued forces of the out flows cannot open the one way valves, when the WGDT is clamped. Through the blown out well head 510, the pressured gas entrainment finds its way into the riser pipe 280, and there from, the gas entrainment is let out from the RGDT. The EDTW and the EDTR are unclamped at this time to electively divert the admixed effluent into the SLGOE unit 34 for an oil gas separation in an oxygen free milieu.

(2) Wherein there is damage to the riser—in this instance the gas entrainment is still let out from the RGDT as also escaping through few or many of the structural breaches until the pressure subdues when the pressure and the fluid level within the riser gradually equalizes with ocean waters. At this time, the outflows through the one way valves also cease. The admixed effluent can be electively diverted into the EDTW and EDTR to reach the SLGOE unit. It implies that even after an extensive damage about the well head structures, beneficially most of the entrainment may be forced out through the WGDT and the RGDT until the one way valves allow.

However, the oil spill into the ocean can be incessant, progressively turning into a spewing geyser. It is due to different densities of the two liquid bodies concerned, the lighter petroleum oil rising to the surface, as the heavier oceanic water finds its way into the oil-containment, progressively rising its pressure. Hence aiming for a swift response to seal the leaks is paramount.

The Riser Restoration after a Well Head Blow Out

Consequent to severe damage upon a well blow-out with structural breaches of the well bore, well head and the marine riser, wherein the breaches communicate with the ocean waters, emergently sealing the breaches of the riser being a simple doable measure as also remedial in most instances, it should be pursued. As the well drilling is no more required of, the function of the riser is herein directed only towards the other mandatory functions of—installing the production tubing as also the down-hole completion, and any of the like. Being done in conjunction with the sealing of all other breaches, the riser's reparative process prevents the ocean water getting into the oil containment. Large visible breaches can be easily identified, however the highest level of imperceptible breaches being hard to discern, the following reparative measures are pursued—

(1) About the lowest riser string (the part of riser usually affected), a vulcanized rubber sheath is glued to the whole of the riser surface using a reliable water-proof glue like plumber's glue, wherein both perceptible and imperceptible breaches of the riser are covered. A thick layer of the glue dried in the back of the sheath is covered by thin sling plastic with intermittent interruptions, wherein each segment of plastic is lifted off as the sheath is glued, like a wall-paper. It implies that the rubber sheath can be applied as large segments with wide overlap.

(2) As each segment is laid down, the overlapping edgings of the rubber sheath is immediately cemented (at least 3 inches width) with hydraulic water stop cement of hand formed consistency (also preserved in plastic sheathing) and the cement in turn is covered with water-proof tape so as the consistency of the cement is preserved; the segment of rubber sheath at a higher level should overlap the one at a lower level-; the gluing and cementing should start with the upper edges of the segment at the highest level, and before the segment's lower edging is done, a lower segment is tucked under; these steps of immediate cementing and taping ensure that the ocean water does not seep underneath the rubber sheathing, preventing its proper approximation with the riser surface for the needed bonding with the glue.

(3) Until the time the glue is set in, a strong wide plastic band is tightly wound around the riser all through the span of the rubber sheath, and the ends of the band are stapled.

(4) Wherein the RGDTs are deployed at any diametrical level, the rubber sheathing as also the cementing are applied in small overlapping dimensions, the coverage additionally extending on to the RGDTs tubing for an optimal distance, to cover their imperceptible fractures.

(5) The rubber sheath also covers the well head and cemented in a similar manner as the riser.

(6) Upon thorough cleaning of a perceived Diameter Of Disruption (DOD) of the ocean grounds about the vicinity of the well head, large visible breaches are filled by sand and gravel, where after cement is poured in 2-3 layers throughout the area to cover all cracks and crevices, wherein the cementing merges with the reinforced edging about the well head.

(7) Bright liquid color is instilled into all the riser tubing from the rig level, and in bright light the color seep into the ocean waters is observed about the highest level of the riser sheathing, and if any color seep is noted, the involved joint of the riser strings is redundantly enveloped with rubber sheath, whereas a full lay-over is continued into the breached higher string. Color testing at this time usually will not reveal a color seep into the ocean waters indicating that the surface of the third string (counted from the bottom) of the riser is intact, as usually it is.

(8) Dysfunctional riser strings of irreparable damage are replaced.

(9) Obviously, the riser restoration is pursued only after a full restoration of the well bore, also herein described, as in most occasions it is in the agenda, being a structure damaged along with.

The Well Bore Restoration after a Well Head Blow Out

It is obvious that only certain well blow outs are amenable for salvaging restoration. Taking into account that well drilling is no more pursued, only restoring a functional state for oil collection in a safe manner is herein aimed, and it commences only after a pressured entrainment optimizes.

A NEW INNERMOST REPARATIVE CASING as devised by the Inventor (U.S. Pat. No. 9,175,549) is a tried and true permanent structuring (like any well casing familiar to the industry). However, when there are marked well head deformations, said REPARATIVE CASING being a rigid tubular, is not a suitable model. Accordingly, a flexible device that easily negotiates well head distortions must be elected. Such devising and its workability are set forth as in the following—

1. The marine riser must be taken out of place to access the well-head, a damaged riser restored following the restoration of the well bore, as the future placement of a production tubing being yet necessary in this setting, unless present practices eliminated the need of a marine riser for the task.

2. As an instant reparative measure, a pliable Steel-Metal Sheath (SMS) with thin rubber under-lay is encircled inside the Inner Most Casing (IMC) 284 as depicted in the well's vertical or axial view of FIG. 9, creating an annulus like space (ALS) to be cemented from above, sealing all the breaches, while metal wire loops hang the SMS to the well head, 3. The circumferential conjoining—if the SMS is segmental in its lengthwise dimension, a circular conjoining is made at the well head by—(a) taping and vertical stapling 2 inches from the circular edges, the measure showing off by white marking; (b) placing upper segmental edges outside the edges of a lower segment, preventing cement drifting into the well bore, if taping is ineffective; (c) as an alternative thereof, the segments are held together by Dyneema (UHMWPE, that is, ultra high molecular weight polyethylene) strands, passed through bored holes of the SMS, wherein two segments can be put together by knotting of the ends of very lengthy Dyneema strands, to be brought to well site, where the segments are approximated and tight-knotted after cutting the loose knots, the foregoing minimizing the under-water time, 4. The vertical conjoining—the SMS is put together into a whole casing-like piece (if can pass the well head) and brought to the well site, or it is passed rolled in, to be spread out and conjoined in the well bore 403, taping and stapling of lengthwise edges done similar as the crosswise conjoining, 5. The Standoff 'Spacers'—the SMS comprises intermittent blade-like vertically positioned Mold-On Centralizers (MOC) as 'standoff' spacers set forth about the rubber under-lay of the SMS facing the IMC 284, the centralizers designed for preventing 0% 'standoff' of the SMS in any area, 6. The lower structuring of the SMS—the lower end of the SMS is appended to a Gutter like Bottom (GB) comprising a rolled out Corded Rubber Terminal (CRT) configured to function like a 'casing-shoe', to hold the Hydraulic Water stop Cement (HWC) added about the top of the ALS from drifting into the well bore. The GB abuts against IMC 284 by maneuvering of a robotic arm. Rigs without robotic arms, can inflate a balloon to fill the well bore at this level, to abut the GB against the IMC 284

7. Cement filling in installments—with the HWC of at least 1 hour consolidating time, to start with, a small amount of dry HWC is added through the opened top of the ALS, and when a foot hold is achieved after setting time of the HWC, increments of HWC are added to the completion of cementing, 8. A pneumatic sealer (the EPSE/SSE, that is, the Evolved Pneumatic Sealing Ensemble or the Simple Sealing Ensemble, wherein the latter model is preferred; U.S. Pat. No. 9,175,549 by the Inventor) is Initially wedged below a lowest well breach when the pressure is in optimal control, a devised oil conduit passing through the stationed EPSE/SSE precluding the pressure rise below. The sealer is stabilized from the rig level, primarily through the sealer's oil conduit reaching the rig.

9. The vulcanized rubber in silicone is the mandated choice for all the devices of rubber in this setting, such as the rubber lining of the SMS and the CRT of the GB.

In the Case of a Detachable Island Rig (DIR)

Reference was made earlier to a domestic U.S. Pat. No. 10,807,681 by the Inventor, wherein a Detachable Island Rig (DIR) is the high-lighted theme, as also in a contemporary CIP titled 'THE OFF SHORE FIRE ESCAPE DEVICES INCLUDING SINKING AND RISING OF A DETACHABLE ISLAND RIG' (domestic U.S. application Ser. No. 17/803,373). In the case of a DIR, the FIGS. 4, 6 and 7 are to be read into, without an air gap shown in these drawings, as essentially rest of the matter is applicable in a similar manner. As their titles imply, the disclosures have great bearing with regard to counter measures encompassing a gas fueled rig fire. Without consulting as also simultaneous implementing of their devised measures, the present invention, by any measure or standard, can only be considered as incomplete.

THE VULCANIZED RUBBER AS THE STRUCTURAL CONSTITUENT—it can be noted that all the rubber washers or any assembly devices of rubber, incorporated in the WGDT, RGDT, EDTW, EDTR, SLGOE unit with its modular capsule, the riser, the conductor and others, are made of vulcanized rubber, the only type that can resist the degrading attack of the petroleum analogs.

The Ultimate Merits of the Invention

The proposed models by any standard encompass simpler methods to prevent a well blow out by diverting a pressured giant gas entrainment into a room of oceanic containment. In the same token, the giant gas entrainment is precluded from reaching the rig level culminating into an explosive rig fire. What needs to be implemented is only a small step forwards, however, with a giant leap in the remedial measures achievable that are the 'ultimate'—for being safe, perfect, unfailing and most importantly being the simplest. More complex a measure is, more prone it is for a failure that may not be countered, especially amidst the desolate oceanic waters. After a century, an enormous simplicity is destined to become an accurate problem solving formula, as was also destined to be enormously time taking in its circuitous derivation by its inventor, as if-'it is no easy venture to believe in a simple possibility of a deemed impossibility'.

The Instant Joint Configurations and Closing Caps

The invention further envisions a model of tubing, and the methods of instant system joining or closing, for all future units, or as a replacement tubing for the existing units. Said tubing is structured to have a deep threaded configuration on the inside traversing the entire lengths. Inner threading is better (though manufacturing is more involved), as an outer threading can collect sediment and lose its precision. The threading of the tubing, small or lengthy, can involve the well and its vicinity, the rig, and finally the appended tubing structures of costly equipment, facilitating instant joining or closing of a compromised or broken structure, aided by means of—

1) 'Instant joint-structures'—these are devised to be shaped as I, T, J, L, C, U, Y etc. with similar inner threading as the tubing itself, to be inserted for system joining, when a conduit line is broken. The working of the joint structures conforms to a sliding screw, aided by two or more conjoining I shaped tubing with complimentary threading on the opposite side. The conjoining I tubing have their threaded outer diameter smaller than the threaded inner diameter of the involved tubing system and the devised 'joint configurations'. When a conjoining I tubing alone is suffice, it is inserted all by itself, as a sliding screw. Most of the times, the I tubing alone can be suitable, and all by themselves sufficient. The conjoining I tubing is made sufficiently long, and the central part colored red, as the visible red central part ensures that the I tubing is screwed in equally and sufficiently long, on either side. The tubing system has its caliber size engraved in equidistance, so that the compatible instant joint structures and the I tubing can be chosen. The middle part of the joint structure is enlarged externally for handling, even by robotic maneuvers.

2) Closing caps—the closing caps have complimentary threading to their stems (having a smaller dimension and outer threading, wherein the tubular system has an inner threading), for closing a system, when system joining is of no option. The stem terminal devised with no threading enlarges to double the size or more, ending in a massive closing cap, to resist pressures at times exerted by the tubular system at the terminal, and the massive cap with similarly sized distal stem is amenable for robotic maneuvers. Simple closing caps with complimentary threading are used to temporarily seal one end of a severed tubing while the other severed end is worked on.

How to find the source of gas/oil leak and mending it—about the oil tubing of the rig confines and outside, oil/gas sensing equipment are placed at equidistance, each numbered, to be defining its territory. When a leak occurs following a tubular damage, its territorial equipment rings its alarm first, though other alarms ring later, as the leak spreads. The devised computer software notes the timing, however, the one that first rang, is the source (unless the leaks are multiple). The leak is confirmed by the adjacent alarms that ring immediately following. The computer sets forth the chronology for an instant information. The security crew familiar with all the numbered territories, should deploy emergently the instant joint structures. As the joint structures are fixed in their allowable maximum dimensions, the length of the tubing to be severed should be properly configured. On the other hand, as the minimal length of a damaged tubing to be severed can be minimized only to a particular dimension, the number of the joint structures to be incorporated (with two or more conjoining I tubes) should be properly configured before severing the tube, as the tubing can be severed 'more' and not 'less'. The I configurations are structured as both 'joint structures' and 'conjoining tubes', the former with similar threading and the latter with complimentary threading. The leak is insulated first, and the tubing including the I tubes to be inserted are articulated outside. After precise measurements the damaged tubing is cut, for the articulated set to be inserted. One cut end is temporarily closed by a simple closing cap, while the other side is worked on. The final manipulations and fine adjustments of the conjoining I tubing are done in-situ to establish a conduit line, with vulcanized rubber washers also, for a fluid tight closures. A distorted tubing may need an intervening U/C joint, and a bent L shaped curve needs a L joint, whereas a complex interconnection needs a T joint. The crew can have a mock practice of possible conjoining maneuvers. The joint configurations can conform to two designs-'subtle' or 'striking' ('Sub' or 'Stri'). In the subtle configurations the devised curves are less obvious. Each is important based on how a broken distorted tubing is dispositioned in its setting.

Unceasing oil/gas emissions from a source that cannot be detected/mended can be a cause of an unceasing fire, or else, for an uncontainable pollution of the eco-system. Hence, the foregoing structural mandates are as important as all the other security measures put together. Moreover, what needs to be herein implemented is only a step forwards in means familiar, how ever, with remedial functions not otherwise achievable in the most precarious of times.

At this concluding part of the multifaceted targeting of a 'gas entrainment' as was discussed in the foregoing many sections, it can be noted that no stone was left unturned, and no adverse event left out to be addressed, yet with the simplest of measures conceivable. This said, with an awareness as was afore noted, that the enormity of the nature's wrath can yet surpass all human limitations, as nothing can tackle a giant gas entrainment or an immense oil gusher that erupts with a sound like hundred trains rushing through the country side, while blowing solid elements into the ocean like lettuce floating in water, as was narrated by an eye witness of a massive well blow out. However, the outlook at this conclusion is greatly and undoubtedly improved.

It is a modern day irony that a gas fueled rig fire is an unresolved concern amidst ocean size of water. Let a giant gas entrainment be dwarfed in a room of oceanic containment.

The invention claimed is:

1. An invention directed to off-shore petroleum oil wells comprising an exemplary prototype model of 'Well Bore to Oceanic Diversion of a Gas Entrainment', said model precluding a well head blow out and a rig fire, whereas in the event of a well head blow out yet happening, the invention further comprising a model of 'Riser to Oceanic Diversion of a Gas Entrainment', to divert the gas entrainment into ocean waters, said encompassing measures of oceanic diversion of a gas entrainment comprising following provisions—

(a) wherein a Well Bore Gas Entrainment Diversion Tubing (WGDT), two in number in circumferential equidistance and falling in a same diametrical line of the oil well, about a predestined distance from a well head, being subject to be constructed following cementing of a hung production (innermost) casing, a tubular design of the WGDT comprising—(i) an Entrainment Let out Tubing (ELT)—a straight tubing of steel emerging from a corner window of a Modular Construction Chamber (MCC) about well side ocean floor, and taking a slanted course through a Ground Transmission Piping (GTP) within the ocean grounds, to be traversing all well casings and emerging into the well bore to be closed by a Gas entrainment Diversion Tubing (GDT) Closure (the GDTC) that opens to the well interior; (ii) an Outgoing Entrainment Tubing (OBT) of steel—the OET articulating with the straight BUT within the MCC, the OET emerging onto ocean grounds from a bottom 'outlet opening' of a MCC wall; (iii) a conjoining tubing of steel—the tubing connecting the OET to a terminal J tubing; (iv) a terminal Inverted J Tubing (IJT) of steel—wherein an upright vertical limb of the J tubing steadied by a sturdy tripod of steel upon the oceanic grounds, while a Down Tuned Terminal (DTT) J curve incorporating a Basket-Pneumosphere Model of one way valves and an appended Small Horizontal Segment (SHS), (b) wherein for isolating ocean waters and deploying the WGDT, said MCC is set upon the ocean grounds by means as follows—(i) a water tight MCC enclosure bolted to leveled well side ocean ground, during deployment of the conductor casing; (ii) the MCC comprising: hooded caster wheels; a closed unbreakable glass door; a closed corner side bottom window to be positioned adjacent to the outermost casing, a window closure opening to MCC interior; the ELT and OET restrained to a wall; a built in interior suction device; and construction tools; (iii) a slanted and broadening Ground Transmission Piping (GTP) of steel embedded within sea floor cementing of the conductor casing, the GTP conjoining the MCC and the conductor casing, for accessing, boring, and tunneling well casings and annuli to be cementing the ELT component of the WGDT within the tunneled casings and annuli, (c) wherein a devised tunneling of the well casings is subject to be done as follows—a burr hole drilled in through the well casings approaching through the GTP and the opened corner window of the MCC, a slanted linear drilling course configured by simple engineering techniques or geological and archeological imaging tools, a dense hanging sphere about well center serving as an aimed focal point, where after, a properly positioned radial burr hole expanded to a tunnel, (d) wherein a structuring of the well side GDT comprising the GDT closure (GDTC) is as set forth below—(i) the ELT about a devised well terminal articulating with a GDT flush plate, a squared rim of steel, wherein onto one side of the rim, a hinged GDT closure (GDTC) with a locking device subject to be closing the squared opening; (ii) about an opposite side of the hinge, the squared rim comprising a complimentary locking device for the GDTC; (iii) the hinged side of the GDTC set forth to be positioned about a side of the well head, as also the GDTC opening towards the well head side; (iv) the locking device of the GDTC devised similar to a locking device of a car door is subject to be opened by remote control, as also requiring a remote operation to be closed; (v) the GDT flush plate being subject to be far larger than the well side tunnel terminal, and set forth to be in flush with and similarly contoured as the production casing, (e) wherein the ELT after being stabilized in the tunnel, the rimmed GDT flush plate secured to innermost production casing by bolting fixtures of the squared rim, while the tunnel side of the GDT closure-lined and edged by vulcanized silicone sealing setting forth a leak-proof GDT closing, (f) (i) wherein through the window of the MCC, the ELT is subject to be cemented within the burrowed tunnel using a slurry of hydraulic water stop cement; (ii) and wherein the burrowing and cementing of the WGDT being done in continuum before proceeding to the WGDT about an opposite side of the well, (g) wherein the well bore comprising gas and oil sensor about a lower level of the GDTC, such sensors also incorporated about the well's midway as also about down hole, their signals opening the GDTC directly, as also the GDTC opened by remote control from a vigilance squad (VS) upon ringing of rig's gas alarms, (h) wherein the ocean side OET terminal emerging out from the MCC is subject to connecting to the IJT by a conjoining tubing, (i) wherein further, electromagnetic waves in ELF and SLF frequency ranges 3-300 Hz serving for signal transmissions of the gas and oil sensors, while the MCC serving as a relay station, where from wiring transmitted through a secure metal tube to the rig site to ring a gas alarm into the rig, whereas color-coded incoming and outgoing wiring travel along with the ELT embedded in cement, (j) wherein furthermore, in the event of a gas entrainment about a time of down hole completion, the gas sensors of the well bore signal the GDTC to be opened, the terminal J tubing's one way valves also being forced open at higher pressures to let out a gas entrainment, (k) wherein, in the foregoing, the gas entrainment about the time of down hole completion being damaging and resulting a well head blow out with structural breaches about the well bore, well head vicinity, and the marine riser, wherein—(i) set forth preventive measures aiding to minimize the well head blow out, and gas entrainment reaching rig confines; (ii) and set forth reparative measures aiding a well bore as also a riser restoration, (l) wherein, in the foregoing, the pressure of the entrainment optimizes and the one way valves of the terminal J tubing no more allow outflows, an admixed effluent subject to be diverted to a 'Sea Level Gas Separator of Oil Well Effluent' (SLGOE) unit, through elective unclamping of an 'Effluent Diversion Tubing of the Well' (EDTW), the SLGOE unit devised for a safe oil-gas separation, and for further diverting moderately pressured gaseous elements into ocean waters, (m) wherein, in the foregoing, the WGDT functioning in oceanic diversion of pressured effluent in instances as set forth below: (i) when drilling the down hole is reaching completion, and subject to a 'kick' from an oil containment; (ii) and upon emergence of a pressured gas entrainment or a pressured oil gusher following a down-hole penetration, (n) wherein, furthermore, in the event of a well head blow out, the invention comprising a model of 'Riser to Oceanic Diversion of a Gas Entrainment' through a 'Riser Gas Entrainment Diversion Tubing' (RGDT), to yet diverting the gas entrainment into ocean waters, as also the admixed effluent diverted to the SLGOE unit by an 'Effluent Diversion Tubing of the Riser' (EDTR), (o) wherein, in the foregoing, any major adverse events being predictably happening about a time of down-hole completion, soon after an uneventful down-hole completion, the WGDT and the RGDT are wholly undone, by dismantling and cement sealing, (p) and in an alternative embodiment, a designing of the WGDT comprising following provisions—(i) wherein for accessing the annuli, standardized size temporary snapping flaps, two in a same diametrical plane, are subject to be devised about well head components of top strings, while also two optimally sized Circular WGDT Openings (CWO) about top strings in same diametrical positions in each string, and in a same vertical plane as the well head snapping flaps—are subject to be made during manufacturing, for WGDT traversing from outside the conductor casing to the well bore, spanning through the casings and the annuli; (ii) wherein, in the foregoing, the WGDT, configured as segmental Individual WGDT Components (IWC) are dis-positioned to be slanted, a high set WGDT terminal reaching ocean floor adjoining the well head, while the IWC spanning the annular space being subject to be made as a duct tubing of silica fabric shaped by vulcanized silicone and steel spring wire, with wide Steel Terminals (ST) of sufficient lengthwise dimension; (iii) wherein said ST fitting onto Nested Receptive Steel Tubing (NRST) of either casing about the annulus, the NRST configured similar as a wide but short bottle neck mounted about a ring Flush Plate of Steel (FPS) comprising bottom vulcanized silicone lining with cuffed extension, the FPS contoured and bolted to the casing; (iv) wherein by rig crew at the rig level, the FPS with NRST is subject to be bolted on both sides of the CWO about either diametrical site of the casing, wherein furthermore, the IWC being also subject to be fitted in the rig about the two outer FPS of a casing, excepting the conductor casing; (v) wherein, in the foregoing, to protect casings to be exposed to drilling fluid and rock cuttings, the well bore side NRST is covered by a double layered Shielding Silicone Disc stretching through the FPS and is cut out upon deploying an inner casing, for the exposed NRST to be conjoining with outer IWC of said inner casing; (vi) wherein, in the foregoing, the GDT flush plate with GDTC of the production casing and the well bore side FPS with IWC of the rest of the casings about one diametrical side being subject to be bolted at the rig level by a robotic arm about the time the rest of the FPS are bolted by the rig crew, all conjoining also sealed by cement of hand formed consistency; (vii) wherein further, the conductor casing about the ocean side of the CWO comprising a large capped Up Slanted Spout (USS) articulating with an ELT Like Steel Tubing (ELST), the latter joining upon ocean floor, with straight or curved conjoining tubing that in turn communicating with IJT; (viii) wherein, in the foregoing, manufacturing the top strings (except production casing) even by imperceptible flaring from bottom to top, widening radial dimension of the top Annular Space (AS) at least by 1 inch, for easy accommodating of the WGDT components within the AS; (ix) wherein, in the foregoing, a proper sealing of the IWC conjoining within the AS being tested by a layered gauze wrapped around for possible staining by colored water injected through the outer NRST of the IWC; (x) wherein furthermore, manufacturing top casings with a second set of NRST at a lower level subject to be an elected option, wherein ocean side ELST ascending vertically adjoining the conductor casing, to then running in parallel with the upper ELST, to be articulating upon ocean floor with the conjoining metal tubing, the latter subject to taking a deviant course from the rest of the tubing; (xi) wherein gas and oil sensors about production casing are better incorporated upon manufacturing, or as an alternative thereof, deployed about accessible interiors of bottom, top, and midway strings by the rig crew, wherein signal transmission wiring is subject to be passing to the rig site through the well head and the riser, to be ringing gas and oil sensing rig alarms.

2. The invention of well bore to oceanic diversion of a gas entrainment, wherein a giant gas entrainment emerging from the WGDT as in claim 1 (j) is subject to be tackled by measures comprising following provisions—

(a) wherein the giant gas entrainment is precluded from rising to surface air-gap by means of incorporating into the WGDT terminal, a 'Gas Fractionation and Diversion' device about a destined time, the device comprising large metal trumpet, that in turn incorporating flexible metal tubing, (b) wherein said device being deployed about a time of drilling the down hole reaching completion and amenable for a 'kick' from an oil containment, when a threaded stem of said metal trumpet is devised to articulate with the small horizontal segment (SHS) terminal of the WGDT, the trumpet's flat bottom comprising at least 4 flexible metal tubing traversing radially to distant oceanic destinations 40-70 meters afar, so as to be fractionating as also distancing the emerging gas entrainment from the air gap about the rig, wherein atmospheric oxygen is deemed to be encountered, as can be an ignition spark, (c) wherein, in the foregoing, two elected options of managing the entrained effluent, are as follows—(i) tackling the entrained gas as also an oil gusher that follows; (ii) letting the gas entrainment into ocean waters, and tackling an oil gusher alone, (d) wherein, in the foregoing, for the rigs electing to tackle the entrained gas as also an oil gusher, the following sets forth the devising and proceeding—(i) wherein about the time of the down-hole completion each open terminal of the four radially traversing trumpet tubing conjoining a large inlet tubing of a gas-oil receptacle, by a sliding screw arrangement, an interior terminal of the inlet tubing devised to be down-turned; (ii) said down-turned terminal of the inlet tubing dipping into bottom column of an enclosed water tank within the gas-oil receptacle; (iii) wherein an outlet tubing of said water tank emerging from an opposite top corner of the tank, preventing water loss from splashes of the tank as a pressured effluent enters the tank, such an undiminished water column facilitating devised function of the one way valves of the WGDT; (iii) the gases emerging from the water tank subject to leaving from two outlet tubing of the gas-oil receptacle to be let into land collection system; (iv) the gas-oil receptacle comprising a video device near a lighted glass window, to be noting a commencement time of oil flow; (v) wherein, a pressured oil-gusher entering the gas-oil receptacle, by an over flow about the water tank, is let out from the gas-oil receptacle via its bottom outlet; (vi) wherein, as in the foregoing, at least four tubing set forth about each trumpet at the WGDT terminal are deemed not to be minimized, (e) wherein, for the rigs electing to tackle only an oil gusher, the following sets forth the proceedings—upon ceasing of the gas entrainment noted by a video device, a terminal of each trumpet tubing secured to ocean floor is dislodged to associate with the inlet tubing of the gas-oil receptacle, wherein the over flowing oil about the water tank let into the land collection system through the bottom outlet of the gas-oil receptacle, (f) wherein multiple land receptacles with outlets clamped, receiving oil and gas, so as said designing as a whole facilitating a securely closed system, an emergency signal upon a gas entrainment prompting land crew for a vigilant watch, (g) wherein, furthermore, facilitating the foregoing provisions, the temperature of the gas-oil receptacles maintained at 4° C. of the deep sea at 200 meters and deeper, aiding in lowering the temperature as also pressure of gaseous elements (the temperature and pressure in a gas containment being directly proportional—the Gay Lussac's law), making the gas-oil collection and land diversion fire-safe, heat being a requirement in a fire triangle, (h) and wherein to start with, the trumpet tubing being positioned towards the shore facilitating an easy traversing of land lines to a coastal destination.

3. The invention of Well Bore to Oceanic Diversion of a Gas Entrainment though devised to precluding a well head blow out and a rig fire, as in claim 1, yet upon a well head blow out happening, the invention further encompassing a devising of 'Riser to Oceanic Diversion of a Gas Entrainment', to yet divert the gas entrainment from the marine riser into the oceanic waters, said encompassing measures setting forth following provisions—

(a) (i) wherein few strings of the riser are manufactured to incorporate a 'Riser's Gas Entrainment Diversion Tubing' (RGDT), the latter originating from riser pipe, wherein a traversing RGDT exteriorized in entirety from outer auxiliary 'power' and 'control' lines; (ii) wherein, a bottom string of the riser, as close to the well head as feasible, is devised to incorporate the RGDT, two in a same diametrical line in circumferential equidistance; (iii) the RGDT originating from the riser pipe is structured as flexible metal tubing for an easy maneuvering through the riser's structures, the origination of the RGDT furthermore accommodating GDT closures (GDTC) that mirror the . . . well's GDTC, as also said riser's GDTC opening about a same time as the well's GDTC are opening; (iv) wherein the remote signal transmitter for opening the GDTC can pass from the rig to the riser pipe; (v) whereas, outside the riser, the RGDT of metal comprising an inflexible J tubing, wherein a horizontal limb of the J tubing emerging from the riser, after coursing 3-4 feet, making a down turn; (vi) wherein said down turned terminal (DTT) subject to incorporating a smoothly curved short horizontal segment (SHS) as also one way valves, the SHS devised to articulating with the trumpet stems, while said one way valves are devised to allowing outflows of the pressured entrainment into ocean waters, but not allowing inflows from the ocean waters, (b) wherein optionally, the RGDT is subject to be structured also about midway of the riser and additionally about any top strings, and all the SHS terminals of the RGDT being capped until the trumpets of the gas fractionation and diversion devices are conjoined, (c) wherein furthermore, about the down turn of the DTT, an up-going 'Effluent Diversion Tubing of the Riser' (EDTR) originates to reach the SLGOE unit, said EDTR normally closed by a sturdy clamp, to be opened at the conclusion of the RGDT functioning (d) wherein furthermore, to be mindful of the time of the RGDT trumpet deployment—it is when a kick from the oil containment becoming an anticipated threat and the WGDT are being deployed with the trumpets, wherein the capped SHS of the RGDT are subject to be uncapped for the trumpets to be incorporated, the RGDT trumpet structuring and functioning being similar as those of the WGDT, (e) and wherein the entrained effluent entering the riser, in a similar manner as the effluent entering the well bore, is subject to be—let out through the one way valves to enter the gas-oil receptacles; let into the SLGOE unit after closing of the one way valves.

4. The invention of Oceanic Diversion of a Gas Entrainment wherein the WGDT and the RGDT being subject to be comprising a 'basket-pneumosphere' model of one way valves within the down turned terminal (DTT) of the IJT as in claim 1, the structuring of the valve being set forth below—

(a) within the DTT, the one way valve comprising a vertically positioned inverted basket like housing, wherein an air-filled pneumatic metal sphere is subject to be housed, (b) within the DTT, an upper pole of the pneumatic sphere being anchored by a metal chain, hung to a diametrical center of a rod structure positioned above the basket, (c) within the DTT, the basket housing of a narrow upper end and a broad lower end, with both ends open, conforming to an inverted nested configuration with the pneumatic sphere wedging about the upper end, and closing the well bore and the riser from ocean waters, (d) wherein the DTT comprising a down turned positioning and uninterrupted distal water column facilitating floating and wedging of the air filled pneumosphere, and closing of oceanic water in flows, (e) within the DTT, the pneumatic sphere subject to be un-wedged as when forced down to the broader lower housing by a gas entrainment, allowing out-flow of entrained gases into the ocean water, (f) within the DTT, the one way valves being set forth as a stack of two, the upper pneumosphere being subject to be smaller, while dimensions of the baskets and the trumpet tubing allowing outward expulsion of both the pneumospheres when blown out by a gas entrainment, and for an anticipated out-flow blockage, four trumpet tubing deemed not to be minimized, and (g) within the DTT, an election of a single housing of one way valve being not differed, when chosen by the crew.

5. The invention of oceanic diversion of a gas entrainment, wherein a giant gas entrainment emerging from the WGDT and the RGDT is subject to be electively diverted to reach the 'Sea Level Gas Separator of Oil Well Effluent' (SLGOE) unit as in claim 3 (e), wherein the devising of and flow principles of the SLGOE unit comprising following provisions—

(a) wherein the SLGOE unit about the surface of the ocean waters and structured in a SLGOE 'modular capsule' of preconfigured sizes comprising a higher level 'gas separator' tank and a lower level 'oil passage' tank, facilitating the effluent flows into the lower level oil passage tank, (b) wherein from a well source and from within the marine riser, the effluent with admixed gaseous elements entering through a top located effluent inlet tubing is subject to be down flowing to bottom of the gas separator tank, (c) wherein within the gas separator tank, the gaseous elements instantly separating from the down flowing effluent, are subject to collecting about the top of the tank, the encountered inflammable gases having low molecular weight, (d) wherein furthermore, the gas separator tank comprising a clustering of wide gas outlet tubing all through the top, an exceeding volume of the gas outlet tubing dissipating great pressure of lesser volume of outflowing gases, the cluster of tubing merging into a large out-going gas pipe emerging from the SLGOE modular unit, (e) wherein furthermore, the gas separator tank comprising concentric sieve like bottom perforations designed to filtering the effluent flowing into a smaller lower compartment comprising a large bottom outlet tube, (f) wherein, in the foregoing, the effluent from the gas separator tank through the outlet tubing entering the oil passage tank to be down-flowing, the oil passage tank comprising top clustering of wide gas outlet tubing, merging into the large out-going gas pipe of the SLGOE modular unit, (g) wherein said oil passage tank comprising a 'siphoning' tube emerging from the SLGOE modular, to be joining an oil collection system, said oil collection means having an intervening 'oceanic pressure let-out tank' with one way valves, the tank letting out highly pressured liquid effluent into ocean waters before the effluent allowed to flowing to the oil collection system, (h) wherein, in the foregoing, the model setting forth a safe and instant oil gas separation as also ease of gas diversion (i) wherein furthermore, the gas separator tank of the SLGOE unit comprising a model of 'spiked circle' oil dispersion device with an up and down axial motion, the spikes of the dispersion device about a downward motion passing through the bottom perforations of the gas separator tank, subject to disrupting a semisolid effluent blocking the perforations, (j) and wherein the gas separator tank of the SLGOE unit is monitored by a video device to detect an obstruction to the effluent down-flow, said video devising set forth below-(i) said device operable by a solar powered battery source located inside the SLGOE modular adjoining a break-proof glass window; (ii) wherein the top of the gas separator tank in an opposite side of oil inlet tube, comprising a window with a glass closure; (iii) wherein the window closure opening to tank's interior and comprising an operation similar as a conventional automated door, wherein an opened door when left ajar, closing automatically after few seconds; (iv) wherein, in the foregoing, with anticipated problems lower down the tank, the video device positioned adjoining the window's glass closure, comprising a down-tilting about a fore structure; (v) wherein a projectile structure about a 'video-rest' pushing on a control button to be opening the window door for the video device to be getting in, for picturing lower tank in a full view; (vi) and the video retreating upon stopping said operation, while the window closure locking in few seconds; (vii) and wherein an additional video within the SLGOE modular documenting proper closure of the tank's window door.

6. The Sea Level Gas Separator of Oil well Effluent (SLGOE) unit, as in claim 1 (l), wherein apart from the oil gas separation, the SLGOE unit being devised for further oceanic diversion of moderately pressured gaseous elements, said measures comprising following provisions—

(a) wherein the SLGOE unit receiving the effluent subject to an anticipated timing, as after capping of the GDTs and un-clamping of the EDTW with or without un-clamping the EDTR, (b) wherein additionally, for oceanic diversion of moderately pressured gaseous elements, the SLGOE unit having structural features as set forth below: (i) the common gas pipe emerging from the SLGOE modular unit having a large 'sideward outlet tube' with one way valve of set forth moderately high pressure threshold, said outlet tube letting out gaseous elements of said high pressure threshold into ocean floor gas receptacles; (ii) a 'clamp' set forth about the common gas pipe immediately distal to said sideward outlet tube; (iii) a L-shaped 'pilot side tube' about a bottom level of the oil passage tank, wherein a horizontal limb of the L-tube let out through the modular unit comprising a vertical limb with a break-proof glass window, subject to showing column features of the oil passage tank; (iv) a 'bi-pronged tube', wherein forging prongs entering either tank of the SLGOE unit nearer to the top; (v) a sturdy 'on and off' clamp to the oil outlet tube emerging from the SLGOE modular, and reaching the oil collection system, (c) wherein for oceanic diversion of moderately pressured gaseous elements, devised steps are set forth as follows—(i) a fluid column within the oil passage tank as non-existent, is noted in the L-shaped pilot tube, where after oxygen-free atmospheric air is pumped through the pronged tubes, while the large common gas pipe of the modular unit as also tubing of surface gas collection system distal to the gas receptacles are kept un-clamped, allowing the SLGOE unit and the gas receptacles to be filled with oxygen-free atmospheric air; (ii) wherein, in the foregoing, upon pumping a measured volume of oxygen-free atmospheric air equaling a volume of the tanks, the gas receptacles plus intervening tubing, the bi-pronged tubing is subject to be closed; (iii) wherein, following, the gas collection system distal to the gas receptacles is clamped saving the oxygen-free atmospheric air in the SLGOE unit and the gas receptacles, for any pressured gaseous elements to be entering a safe oxygen-free milieu of the tanks; (iv) wherein furthermore, the oil-outlet tubing of the SLGOE unit is subject to be clamped while pumping the oxygen-free atmospheric air; (v) wherein subsequent to the foregoing, the EDT(s) are unclamped, and in 1-2 minutes the gas collection system distal to the gas receptacles is also un-clamped, for optimally pressured gaseous elements to be entering the gas receptacles; (vi) wherein, in the foregoing, the pressured gaseous elements entering the top gas outlets are subject to be let out through the one way valve(s) of the sideward tube opening to higher pressure threshold; (vii) wherein furthermore in the foregoing, said pressured gaseous elements are subject to be let into bottom water column of ocean floor gas receptacle(s); (viii) wherein upon crew divers noting no gas bubbles emerging from the bottom water column of the ocean floor gas receptacles as also the pilot side tube showing fluid column indicating an oil flow, the oil outlet tubing of the SLGOE unit is subject to be unclamped to be commencing oil collection; (ix) wherein as in the foregoing, for a routine oil-gas separation about the rig site, the sideward outlet tube facilitating the pressured gaseous elements to be let into the ocean floor gas receptacles, while a gas flow of optimal pressure entering the surface gas receptacles, (d) wherein furthermore, separated oil of the SLGOE unit returning to the rig, is subject to traversing an 'oceanic pressure let-out tank', with pressured oil gusher briefly let into the ocean waters through a pipe with one way valves of set forth pressure threshold, while the oil is collected soon after, by massive floating oil receptacle, (e) whereas, the SLGOE unit is set forth to be initially stationed at a safe distance from the rig, upon cumulative experience and derived safety profile, the unit is allowed to be stationed in a rig or a place adjacent, (f) and, whereas an oil company can be electing the SLGOE unit for all time rig site gas separation and collection in a safe controlled manner with elements of higher pressure let into the subsea gas receptacles, an incorporation of the SLGOE unit can be elected as also occasional, to be letting out moderately pressured effluent, as after a giant gas entrainment.

7. The prototype SLGOE unit is subject to be configured within a modular capsule as in claim 5, wherein the structuring and stationing of the modular comprising following provisions—

(a) wherein the modular enclosure capsule of the SLGOE unit with inlet and outlet tubing temporarily capped, is deployed about oceanic rig vicinity, a barge-like base structuring of the modular resisting oceanic perturbations, (b) wherein compatibility of the modular unit configured by standardized number and size of the incorporated inlet and outlet tubing, (c) wherein the modular being reversibly affixed to the barged base structure by hooks, ring structures and bolting hardware, (d) wherein furthermore—(i) the modular can be erected upon a single leg or anchored to the leg of the rig by units of strings below the surface water; (ii) wherein each unit subject to be made of two strings of metal rods, adjoining metal rods of a string connected by a 'linkage ring'; (iii) wherein said linkage ring with linked terminals of the rods, fixed to center of an adjacent rod of a paired string of the unit, preventing downward or sideward bending, so as the modular maintaining desired linear dimension from the rig, as also precluding collision with the leg, (e) wherein the units of metal strings in hemi-hammock arrangement fan towards the modular, and by interconnecting metal ropes the strings making a grid with an atop metal barge stationing the modular, (f) wherein furthermore—(i) the strings and the modular, about the center of the grid supported by a bottom row of large submerged polyvinyl chloride (PVC) blocks with locked-in air columns, said PVC blocks in turn steadied by paired bottom metal strings tangentially radiating upwards from the leg of the rig, said tangential strings countering the PVC air blocks from floating to the surface; (ii) a submerged pathway to the rig is set forth atop the hammock; (iii) the PVC blocks with locked in air columns supporting the metal strings as also the modular, imposing no undue load upon the leg, (g) whereas, as an alternative thereof, a submerged 'anchor' devised as a base support to the modular, wherein: (i) the anchor affixed to a rig's reinforced leg structure under water, air-locking metal columns of the anchor obviating strain upon the leg; (ii) the anchor columns rising to the water surface in an incline comprise an air locking PVC block with an atop metal barge as a modular platform; (iii) the anchor columns are subject to be stabilized by 'hoisting metal ropes' horizontally coursing from the leg, a lower of the 'hoisting ropes' substituted by units of metal strings made of said overlapping metal rods without downward or sideward bending; (iv) upon submerged air-locking PVC blocks stabilized by bottom 'hoisting-ropes' lays a submerged path way to the rig, (h) and wherein the SLGOE modular unit additionally comprising-(i) corridors with a door access; (ii) fire-safe devices of: enveloping burlaps; alarm activated high powered sprinklers and wind-blowing fans upon a frame work of scant exoskeleton; powerful sprinklers jetting about surface waters outside the corridors, distancing surface fire upon oil-laden waters.

8. The Sea Level Gas Separator of Oil Well Effluent (SLGOE) unit, wherein an oil dispersion unit in a 'spiked circle' model is being incorporated into the gas separator tank of the SLGOE unit as in claim 5 (i), said oil dispersion unit having following provisions—

(a) wherein the oil dispersion unit of steel, comprising: (i) a dispersion device made of concentric circles connected by two radially positioned members in equidistance; (ii) a centrally positioned vertical rod supporting the dispersion device, said supporting rod fitted to a top structure of the gas separator tank; (iii) a top 'motion control' device outside the tank, facilitating axial motion of the supporting rod, (b) wherein the oil dispersion device further comprising a lamp shade configuration, wherein the shade having a minimal incline, (c) wherein the oil dispersion device further comprising axial motion, wherein about a downward motion, the concentric circles with bottom cutting edges severing solid and semisolid effluent about an area of the bottom perforations of the gas separator tank, (d) wherein the oil dispersion device, about the bottom cutting edges furthermore comprising spiked structures corresponding to the bottom perforations of the gas separator tank, the spikes passing through the bottom perforations in an axial downward motion, disrupting blocks about the perforations, (e) wherein the bottom cutting edges positioned about center of the concentric circles being structured longer, so as the bottom spiked structures are subject to staying about a same horizontal plane, to be passing through the bottom perforations of the tank, (f) and wherein the axial motion of the supporting rod of the dispersion device conforming to external controls structured outside the gas separator tank, within the SLGOE modular enclosure.

9. The invention of oceanic diversion of a gas entrainment though devised to precluding a well head blow out as in claim 1, yet upon a well head blow out happening breaching the marine riser, a largely water admixed effluent received by the SLGOE unit is diverted into an 'Oil Separator tank of Water admixed Effluent' (OSWE), to separate a major portion of water, said devising setting forth following provisions—

(a) wherein a tank of the OSWE isolating oil from a largely water admixed effluent from the SLGOE unit, (b) wherein, in the foregoing, due to relative densities of two liquid bodies concerned, water of the effluent subject to be settling to bottom of the OSWE tank, while the oil rising to top, upon the admixed effluent reaching the tank through a sideward inlet tube entering above midway of the tank, (c) wherein further, about an opposite side, near the top of the tank, oil leaving through an oil out let, whereas from the bottom of the tank, settled water flowing out through a water outlet into ocean, (d) wherein furthermore, inflows and outflows of the tank are subject to be controlled by flow clamps to be maintaining fluid levels within the tank so as the inflows through the sideward inlet tube is not subject to be a down-flow, but a tempered sideward merging above the midway of fluid column, causing no undue perturbations in settled layers of different densities, (e) and wherein, with incoming ocean water of large volume, a separation facilitating returning water to the ocean with no significant contamination, and oil collected with no water admixed in large amount, while samples of outflowing water into the ocean being periodically tested, to be controlled for hydrocarbon content.

10. The invention of oceanic diversion of a gas entrainment though devised to precluding a well head blow out, upon well head blow-out yet happening, with structural breaches of the well bore, well head vicinity, and the marine riser, with the breaches found communicating with ocean waters, restorative measures about the marine riser as in claim 1 (k), setting forth following provisions—

(a) wherein, after possible restoration of a damaged well bore, immediate sealing of the riser breaches pursued when the riser is found to be functional, yet a higher level of imperceptible riser breaches being hard to discern, the riser reparative measures being pursued as follows, (b) wherein, about lowest riser string, a part of riser usually affected, a wall paper like vulcanized rubber sheath is glued to whole of riser surface using a reliable water-proof glue, wherein the glued back of the sheath being covered by thin sling plastic rather than a paper, with intermittent interruptions, large segments of glued rubber being laid down with wide overlap, (c) wherein, in the foregoing, as each segment being laid down, overlapping edgings of the rubber sheath are subject to be immediately cemented with hydraulic water stop cement of hand formed consistency (preserved in plastic sheathing), spread out at least 3 inches wide, said cementing in turn covered immediately with water-proof tape, wherein the segmental rubber sheath at a higher level is set forth to be overlapping the one at a lower level, (d) wherein, in the foregoing, the gluing and cementing are subject to be starting with upper edging of a segment at a highest level, wherein a lower segment being tucked under before the segment's lower edging is cemented, (e) while until secure gluing of the rubber sheath, the riser string is wound by a strong wide plastic band with ends stapled, (f) wherein the RGDTs were deployed, the riser's rubber sheathing as also the cementing are subject to be applied in small overlapping dimensions extending on to RGDT tubing, to be covering imperceptible fractures, (g) said sheathing and cementing are subject to be also extending to the well head, (h) furthermore, a perceived Diameter Of Disruption (DOD) of ocean grounds about the well head is slurry-cemented in 2-3 layers upon filling large visible breaches with sand and gravel, (i) wherein, further to discern breaches of higher level—(i) liquid coloring is subject to be instilled into the riser, and in bright light color seep into ocean waters observed about highest level of the riser sheathing; (ii) upon a color seep marking higher breaches, involved joint is subject to be enveloped with rubber sheath in a redundant manner, and a full rubber sheathing continued onto breached higher string, where after, absent color seep into ocean waters indicating an intact higher third string of the riser, (j) and wherein, dysfunctional riser strings of irreparable damage are deemed for replacement.

11. The invention of oceanic diversion of a gas entrainment though devised to precluding a well head blow out, upon well head blow-out yet happening, with structural breaches of the well bore, well head vicinity, and the marine riser, with the breaches found communicating with ocean waters as in claim 1 (k), upon subduing of a gas entrainment, a devised restoration about the well bore setting forth following provisions—

(a) wherein, as a restorative measure, the marine riser is taken out of place, to be accessing the well head, the well restoration taking place before a damaged riser restoration, (b) wherein a well restorative device comprising a pliable Steel Metal Sheath (SMS) with thin vulcanized rubber under-lay encircled inside the Inner Most Casing (IMC) creating an Annulus Like Space (ALS) to be cemented from above sealing all the breaches of the IMC, while metal wire loops hang the SMS to the well head, (c) wherein the SMS is segmental in a lengthwise dimension, a circular conjoining being made at the well head—(i) by taping and vertical stapling two inches from circular edges, the measure showing off by white markings; (ii) by placing edging of an upper segment outside of an edging of a lower segment subject to preventing cement drifting into the well bore, upon an ineffective taping; (iii) wherein as an alternative thereof, the segments are held together by ultra high molecular weight polyethylene strands passed through bored holes of the SMS, wherein two segments are subject to be put together off the well site, by loose knotting of ends of very lengthy strands, whereas the segments being tight-knotted about the well site upon cutting off the loose knots, the plan minimizing underwater time, (d) wherein further, with minimal well head distortions—(i) the SMS is subject to be put together into a whole casing-like piece to be brought to the well site; (ii) and wherein, as an alternative thereof, the SMS passed as a rolled in sheet to be fully spreading out within the well bore, the taping and stapling for lengthwise conjoining done similar as the circular conjoining, (e) wherein furthermore, the SMS comprising blade-like vertically positioned 'mold-on' centralizers that are 'standoff' spacers set forth upon the SMS facing the IMC, the centralizers designed for preventing 0% 'standoff' of the SMS, (f) wherein, in the foregoing—(i) a configured lower end of the SMS being appended with a stout Gutter like Bottom (GB) comprising a corded Rubber Terminal (CRT) of vulcanized rubber, a designing functioning like a 'casing-shoe', to be holding up powdered Hydraulic Water stop Cement (HWC) added down through the top of the ALS, while the GB maneuvered by robotic arms to be abutting against the IMC; (ii) wherein as an alternative thereof, a balloon inflated to be filling the well bore being subject to abut against the GB, (g) wherein, in the foregoing, the HWC is chosen with at least 1 hour consolidating time, wherein to start with a small amount of powdered HWC is added through whole circular dimension of a open top of the ALS, and when a foot hold is achieved after setting time of the HWC, increments of HWC are added to completion of the whole SMS cementing, (h) and wherein initially, upon well pressure staying in optimal control, a pneumatic sealer, a EPSE or SSE (that is, an Evolved Pneumatic Sealing Ensemble or a Simple Sealing Ensemble) is wedged below a lowest well breach, a devised oil conduit passing through the stationed EPSE or SSE precluding the pressure rise below, as also creating an oil-free milieu to work on, for the SMS deployment.

* * * * *